US006363338B1

(12) United States Patent
Ubale et al.

(10) Patent No.: US 6,363,338 B1
(45) Date of Patent: Mar. 26, 2002

(54) QUANTIZATION IN PERCEPTUAL AUDIO CODERS WITH COMPENSATION FOR SYNTHESIS FILTER NOISE SPREADING

(75) Inventors: Anil Wamanrao Ubale, San Francisco; Grant Allen Davidson, Burlingame, both of CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 09/289,865

(22) Filed: Apr. 12, 1999

(51) Int. Cl.[7] ..... G10L 19/02
(52) U.S. Cl. ..... 704/200.1; 704/229; 704/230
(58) Field of Search ..... 704/200.1, 229, 704/230

(56) References Cited

U.S. PATENT DOCUMENTS 5,222,189 A * 6/1993 Fielder ..... 704/229
5,301,255 A * 4/1994 Nagai et al. ..... 704/230
5,913,191 A * 6/1999 Fielder ..... 704/230

* cited by examiner

*Primary Examiner*—Tālivaldis Ivars Šmits
(74) *Attorney, Agent, or Firm*—David N. Lathrop, Esq.; Gallagher & Lathrop

(57) ABSTRACT

Many perceptual split-band coding systems that use analysis and synthesis filters assume the quantization noise introduced by quantizing split-band signals is substantially the same as the noise that results in the output signal obtained by applying the synthesis filters to the quantized split-band signals. In general, this assumption is not true because the synthesis filters modify or spread the quantization noise. A theoretical framework for deriving an optimum bit allocation that accounts for synthesis-filter noise spreading is disclosed. In concept, the problem of finding an optimal bit allocation can be expressed as a linear optimization problem in a multidimensional coordinate space. Simplified processes derived from this theoretical framework are disclosed that can obtain near-optimal solutions using modest computational resources.

31 Claims, 6 Drawing Sheets

QUANTIZATION IN PERCEPTUAL AUDIO CODERS WITH COMPENSATION FOR SYNTHESIS FILTER NOISE SPREADING

TECHNICAL FIELD

The present invention relates generally to the perceptual coding of digital audio signals that uses analysis filters for encoding and synthesis filters for decoding. The present invention relates more particularly to the quantization of subband signals in perceptual coders that takes into account the spreading of quantization noise by the synthesis filters.

BACKGROUND ART

There is a continuing interest to encode digital audio signals in a form that imposes low information capacity requirements on transmission channels and storage media yet can convey the encoded audio signals with a high level of subjective quality. Perceptual coding systems attempt to achieve these conflicting goals by using a process that encodes and quantizes the audio signals in a manner that uses larger spectral components within the audio signal to mask or render inaudible the resultant quantizing noise. Generally, it is advantageous to control the shape and amplitude of the quantizing noise spectrum so that it lies just below the psychoacoustic masking threshold of the signal to be encoded.

A perceptual encoding process may be performed by a so called split-band encoder that applies a bank of analysis filters to the audio signal to obtain subband signals having bandwidths that are commensurate with the critical bands of the human auditory system, estimates the masking threshold of the audio signal by applying a perceptual model to the subband signals or to some other measure of audio signal spectral content, establishes a quantization resolution for quantizing each subband signal that is just small enough so that the resultant quantizing noise lies just below the estimated masking threshold of the audio signal, and generates an encoded signal by assembling the quantized subband signals into a form suitable for transmission or storage. A complementary perceptual decoding process may be performed by a split-band decoder that extracts the quantized subband signals from the encoded signal, obtains dequantized representations of the quantized subband signals, and applies a bank of synthesis filters to the dequantized representations to generate an audio signal that is, ideally, perceptually indistinguishable from the original audio signal.

The perceptual models that are often used to determine the quantization resolution generally assume that the quantization noise introduced into the quantized subband signals is substantially the same as the noise that results in the output signal obtained by applying a bank of synthesis filters to the quantized subband signals. In general, this assumption is not true because the synthesis filters modify or spread the quantization noise spectrum. As a consequence, quantization performed strictly according to the quantization resolutions obtained by applying these perceptual models usually results in audible noise in the output signal obtained from the synthesis filters.

This noise-spreading phenomenon is true for a wide variety of implementations for the analysis and synthesis filters. These implementations include polyphase filters, lattice filters, the quadrature mirror filter, various time-domain-to-frequency-domain block transforms including a wide variety of Fourier-series type transforms, cosine-modulated filterbank transforms and wavelet transforms. For convenience, signal analysis and signal synthesis techniques that are suitable for use with the present invention are all referred to herein as the application of analysis filters and synthesis filters, respectively. In transform implementations, the subband signals each comprise a group of one or more frequency-domain transform coefficients.

The synthesis filter noise-spreading property mentioned above is related to the fact that the complementary analysis and synthesis filters used in these coding systems do not implement ideal filters having a flat unitary-gain in the passband, zero-gain in the stopbands, and infinitely steep transitions between the stopbands and the passband. As a consequence, the analysis filters provide only a distorted measure of the spectral content of an input audio signal. Furthermore, some filters such as the quadrature mirror filter (QMF) and the time-domain aliasing cancellation (TDAC) transforms generate significant aliasing artifacts that further distort the spectral measure of the input signal. In principle, these artifacts and deviations from perfect filters can be ignored because complementary pairs of analysis and synthesis filters can be used in which the synthesis filters are able to reverse the distortions of the analysis filter and perfectly reconstruct the original input signal.

Although perfect reconstruction is possible in principle, it is not achieved in practical coding systems because perfect reconstruction requires the synthesis filters to receive a precise representation of the subband signals generated by the analysis filters. Instead, the synthesis filters receive a representation with significant errors that are introduced by the quantization processes described above. As a result, subband signal quantization introduces errors that manifest themselves as noise in the signal that is reconstructed by the synthesis filters. As disclosed in U.S. Pat. No. 5,623,577, which is incorporated herein by reference in its entirety, the quantizing errors in a subband signal are spread by the synthesis filters into a range of frequencies that can be wider than the frequency subband of the quantized subband signal itself.

Unfortunately, perceptual encoding processes like those described above do not quantize the subband signals in an optimum manner because the quantization processes do not include a proper consideration for the noise-spreading process that occurs in the synthesis filters. Coding techniques disclosed in U.S. Pat. No. 5,301,255 do include some allowance for the aliasing that is generated by decimating the output of an analysis filter but these techniques do not provide any allowance for noise spreading in the synthesis filter. As a result, these processes overestimate the quantization resolutions that render the quantizing noise inaudible. This deficiency can be compensated to some degree by either forcing the level of the estimated masking threshold to be lower than an accurate perceptual model would indicate, or by uniformly decreasing the quantization resolution below that which an accurate perceptual model would indicate is sufficient to render the quantizing noise inaudible. Neither form of compensation is optimum because they do not properly account for the cause of the deficiency.

U.S. Pat. No. 5,623,577 discloses several techniques that compensate for the noise-spreading effect of synthesis filters. The theoretical basis of the disclosed techniques assumes the degree of noise spreading can be determined by convolving the quantization noise spectrum with the synthesis filter frequency response. Disclosed embodiments of the techniques determine whether compensation for synthesis filter noise spreading is required by comparing frequency-domain slopes of an estimated masking threshold with threshold values that are determined empirically. Unfortunately, these techniques are not optimum because the accuracy for determining whether compensation is needed is suboptimal, the steps required to obtain the needed empirical threshold values are expensive and time consuming, and the disclosed techniques do not take into consideration the effects of overlap-add processes that are included in some synthesis filters such as QMF and the TDAC transforms. In addition, the disclosed techniques do not provide an ability for a particular embodiment to gracefully tradeoff the accuracy of compensation against the computational resources required to carry out the embodiment.

DISCLOSURE OF INVENTION

It is an object of the present invention to improve the performance of perceptual coding systems and methods that use analysis and synthesis filters by providing a quantization process that accurately compensates for noise spreading in synthesis filters.

Advantageous embodiments of the present invention are able to determine the need for noise-spreading compensation in a manner that is more accurate than other known methods and to provide a graceful tradeoff between the accuracy of compensation and the level of computational resources required to provide the compensation.

According to one aspect of the present invention, a method or apparatus determines quantization resolutions for subband signals obtained from analysis filters applied to an input signal by generating a desired noise spectrum in response to the input signal and applying a synthesis-filter noise-spreading model to obtain estimated noise levels in subbands of an output signal obtained from synthesis filters. The synthesis-filter noise-spreading model represents noise-spreading characteristics of the synthesis filters and the quantization resolutions are determined such that a comparison of the desired-noise spectrum with the estimated noise levels satisfies one or more comparison criteria. The method may be embodied as a program of instructions on a medium that is readable by a device for execution by the device.

According to another aspect of the present invention, a medium conveys encoded information that comprises signal information that represents quantized components of subband signals generated by applying analysis filters to an input signal and control information that represents quantizing resolutions of the quantized subband signal components. The quantizing resolutions are determined as summarized above.

According to yet another aspect of the present invention, an apparatus receives and decodes a signal conveying the encoded information summarized above. The receiver comprises an input coupled to the signal conveying the encoded information; one or more processing circuits coupled to the input that extract the signal information and the control information from the encoded information and obtain therefrom the quantized subband signal components and the quantizing resolutions of the quantized subband signal components, dequantize the quantized subband signal components according to the quantizing resolutions to obtain dequantized subband signals, and apply synthesis filters to the dequantized subband signals to generate an output signal. The quantizing noise in the subband signals is spread by the synthesis filters to produce noise levels in subbands of the output signal that substantially satisfy the one or more comparison criteria with the desired-noise spectrum; and an output coupled to the one or more processing circuits that conveys the output signal.

The various features of the present invention and its preferred embodiments may be better understood by referring to the following discussion and the accompanying drawings in which like reference numerals refer to like elements in the several figures. The contents of the following discussion and the drawings are set forth as examples only and should not be understood to represent limitations upon the scope of the present invention.

MODES FOR CARRYING OUT THE INVENTION

A. Overview

1. Encoder

Figure 1A:
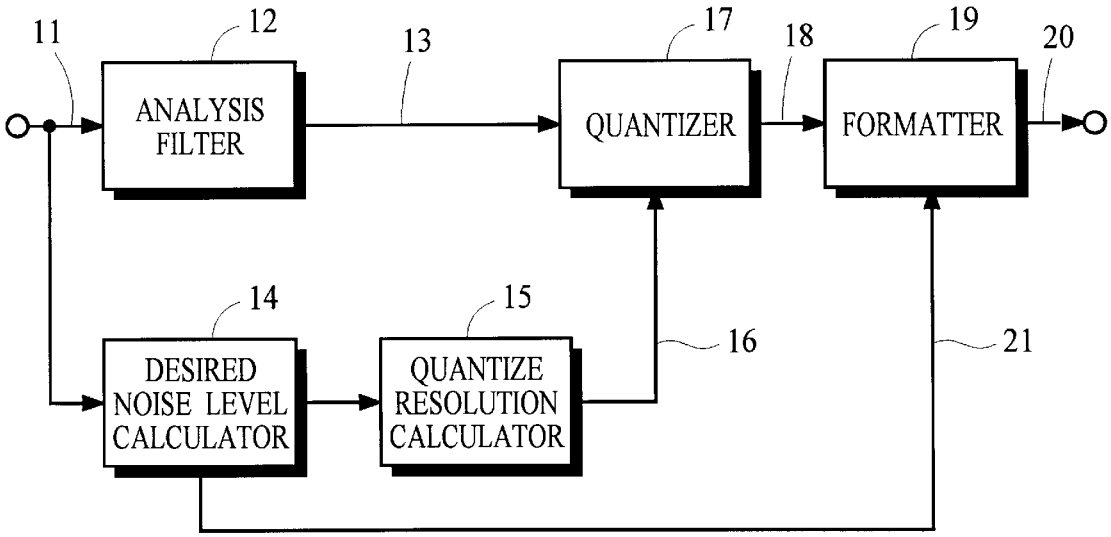
FIGS. 1A and 1B are block diagrams of split-band encoders.

FIG. 1A illustrates one embodiment of a split-band encoder incorporating various aspects of the present invention in which a bank of analysis filters 12 is applied to a digital audio signal received from path 11 to generate frequency-subband signals along path 13. The bank of analysis filters may be implemented in a wide variety of ways. In preferred embodiments, the bank of filters is implemented by weighting or modulating overlapped blocks of digital audio samples with an analysis window function and applying a particular Modified Discrete Cosine Transform (DCT) to the window-weighted blocks. This MDCT is referred to as a Time-Domain Aliasing Cancellation (TDAC) transform and is disclosed in Princen, Johnson and Bradley, "Subband/Transform Coding Using Filter Bank Designs Based on Time Domain Aliasing Cancellation," *Proc. Int. Conf. Acoust., Speech, and Signal Proc.,* May 1987, pp. 2161–2164.

In the embodiment shown, desired noise level calculator 14 analyzes the digital audio signal received from path 11 to estimate the psychoacoustic masking threshold of the audio signal and to obtain a desired noise level in response thereto. In preferred embodiments, the desired noise level is established at a level that is substantially equal to the psychoacoustic masking threshold that is obtained using a good perceptual model such as those disclosed in Schroeder, Atal and Hall, "Optimizing Digital Speech Coders by Exploiting Masking Properties of the Human Ear," *J. Acoust. Soc. Am.*, December 1979, pp. 1647–1652 and in U.S. Pat. No. 5,623,577. Although no particular technique is critical in principle to practice the present invention, the performance of actual implementations is generally enhanced by using sophisticated perceptual models that can provide accurate estimates of the masking threshold.

In response to the desired noise level received from desired noise level calculator 14, quantize resolution calculator 15 uses a noise-spreading model to determine the quantization resolutions to use for quantizing the subband signals and passes an indication of these quantization resolutions along path 16. The noise-spreading model represents the noise-spreading characteristics of a bank of synthesis filters and is used to estimate the noise in an output signal that is obtained by applying the synthesis filters to the subband signals that are quantized according to the quantization resolutions. Quantize resolution calculator 15 determines the quantization resolutions such that, according to the noise-spreading model, the output signal obtained from the synthesis filters has a level of noise resulting from the quantization that is substantially equal to the desired noise level.

Quantizer 17 quantizes the subband signals received from path 13 according to the quantization resolution information received from path 16 to generate quantized signals along path 18. Quantizer 17 may be implemented by a variety of quantization functions using uniform or non-uniform step sizes including linear quantization, logarithmic quantization, Lloyd-Max quantization and vector quantization. The resolution of the quantization provided by quantizer 17 may be controlled by varying the number of quantization steps, varying the dynamic range represented by a given number of steps, and/or altering the values represented by each quantization step. In some embodiments, the number of quantization steps is varied by allocating a number of bits and selecting a quantizer with a corresponding number of steps. Although the particular form of quantization used in a particular embodiment may have significant effects on performance, no particular quantization function is critical in principle to the practice of the present invention.

Formatter 19 assembles the quantized signals into an encoded signal and passes the encoded signal along path 20 to be conveyed by transmission media such as baseband or modulated communication paths throughout the spectrum including from supersonic to ultraviolet frequencies, or storage media including those that convey information using essentially any magnetic or optical recording technology including magnetic tape, magnetic disk, and optical disc.

In backward-adaptive embodiments, an indication of the signal characteristics used by desired noise level calculator 14 is passed along path 21 and assembled into the encoded signal. In forward-adaptive embodiments, neither path 21 nor the information passed along path 21 are needed because an indication of the quantization resolutions used to generate the quantized signals is assembled into the encoded signal. Formatter 19 may also use an entropy encoder or other form of lossless encoder to reduce the information capacity requirements of the encoded signal.

Figure 1B:
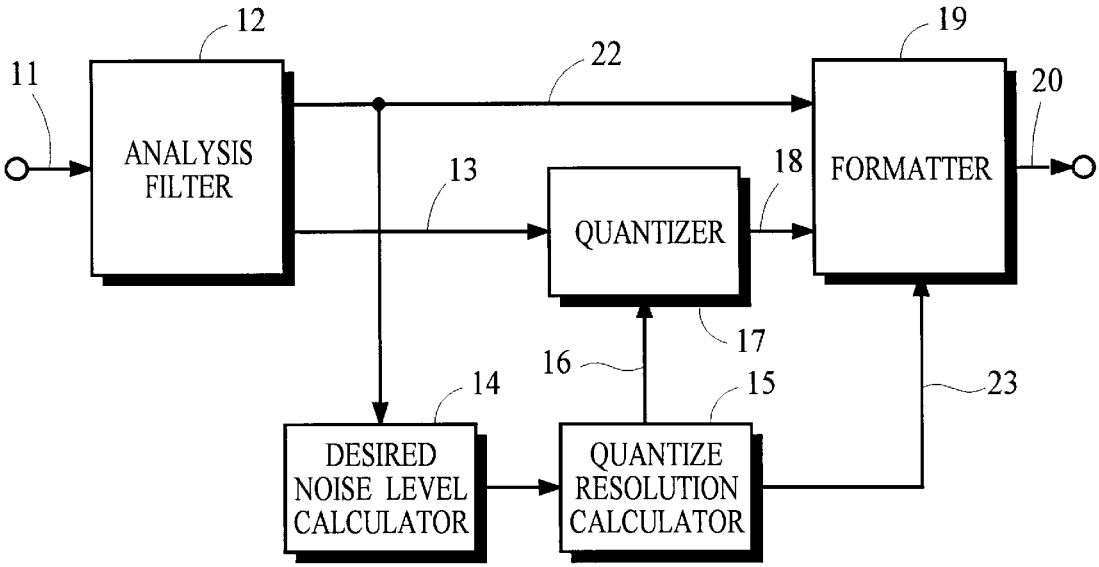

FIG. 1B illustrates another embodiment of a split-band encoder incorporating various aspects of the present invention that is similar to the embodiment discussed above. A few of the differences between these two embodiments are discussed here.

A bank of analysis filters 12 is applied to a digital audio signal received from path 11 to generate frequency-subband signals along path 13 and to generate information representing the input signal spectral envelope along path 22. For example, subband signal components may be represented in a block-floating-point (BEP) form in which the BFP exponents are essentially logarithmic scaling factors representing the peak component value in each subband. The BFP exponents may be used as the input signal spectral envelope information. The bank of analysis filters may be implemented in a wide variety of ways as discussed above.

Desired noise level calculator 14 analyzes the spectral envelope information received from path 22 to estimate the psychoacoustic masking threshold of the audio signal and to obtain a desired noise level in response thereto. In response to the desired noise level received from desired noise level calculator 14, quantize resolution calculator 15 uses a noise-spreading model as explained above to determine the quantization resolutions to use for quantizing the subband signals and passes an indication of these quantization resolutions along path 16.

Quantizer 17 quantizes the subband signals received from path 13 according to the quantization resolution information received from path 16 to generate quantized signals along path 18. Quantizer 17 may be implemented and controlled as discussed above. Formatter 19 assembles the quantized signals received from path 18 and the spectral envelope information received from path 22 into an encoded signal and passes the encoded signal along path 20 as explained above. Formatter 19 may also use an entropy encoder or other form of lossless encoder as discussed above.

The embodiment illustrated in FIG. 1B may be used in backward-adaptive coding systems because the information needed by the desired-noise-level calculator is conveyed in the encoded signal by the spectral envelope information. No additional information is needed by a complementary decoder that incorporates counterpart components to desired noise level calculator 14 and quantize resolution calculator 15. In another embodiment, desired noise level calculator 14 provides a set of initial quantization resolutions and quantize resolution calculator 15 modifies one or more of these initial resolutions as necessary to carry out noise-spreading compensation according to the synthesis-filter noise-spreading model discussed above. An indication of these modifications is passed along path 23 and assembled into the encoded signal by formatter 19. By including this additional information, the encoded signal can be decoded without use of the synthesis-filter noise-spreading model.

2. Decoder

Figure 2A:
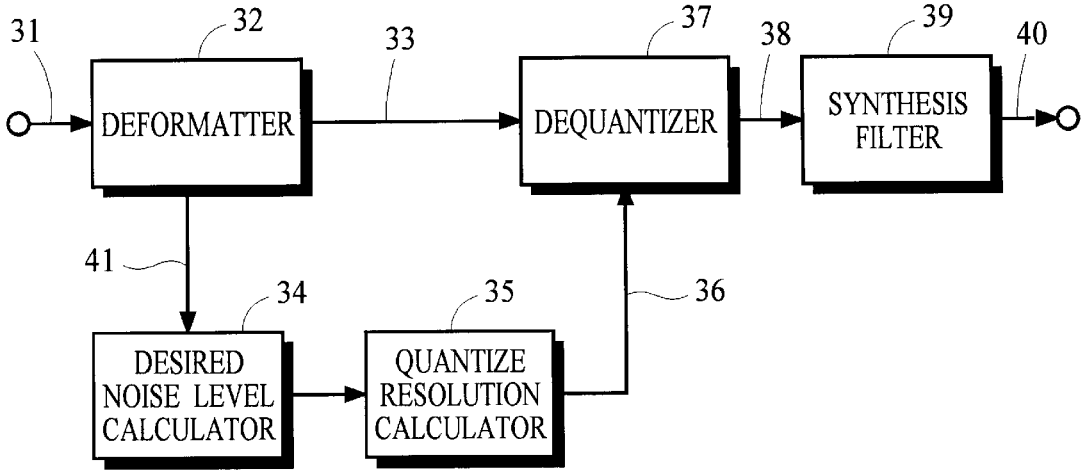
FIGS. 2A and 2B are block diagrams of split-band decoders.

FIG. 2A illustrates one embodiment of a split-band decoder incorporating various aspects of the present invention in which deformatter 32 extracts quantized signals from an encoded signal received from path 31 and passes the quantized signals along path 33. Deformatter 32 may also use an entropy decoder or other form of lossless decoder as necessary to obtain the quantized signals.

In the embodiment shown, deformatter 32 also extracts from the encoded signal an indication of the signal characteristics used by desired noise level calculator in a companion encoder and passes this indication to desired noise level calculator 34, which obtains the desired noise level in response thereto. In response to the desired noise level received from desired noise level calculator 34, quantize resolution calculator 35 uses a noise-spreading model as explained above to determine the quantization resolutions that were used to generate the quantized signals and passes an indication of these resolutions along path 36.

Dequantizer 37 dequantizes the quantized signals received from path 33 according to the quantization resolution information received from path 36 and generates dequantized subband signals along path 38. Dequantizer 37 may be implemented and controlled in a variety of ways as discussed above for quantization. No particular dequantization function is critical in principle to the practice of the present invention but should be complementary to the quantization process used to generate the quantized subband signals.

A bank of synthesis filters 39 is applied to these dequantized subband signals to generate an output signal along path 40. The bank of synthesis filters may be implemented in a wide variety of ways. In preferred embodiments, the bank of synthesis filters is implemented by applying an inverse MDCT, referred to as the inverse TDAC transform, to blocks of transform coefficients, weighting the signal samples obtained from the transform with a synthesis window function, and overlapping and adding samples in adjacent window-weighted blocks.

In a forward-adaptive system not shown, neither desired noise level calculator 34 nor quantize resolution calculator 35 are needed because deformatter 32 is able to extract quantization resolution information from the encoded signal and provide this information to quantizer 37.

Figure 2B:
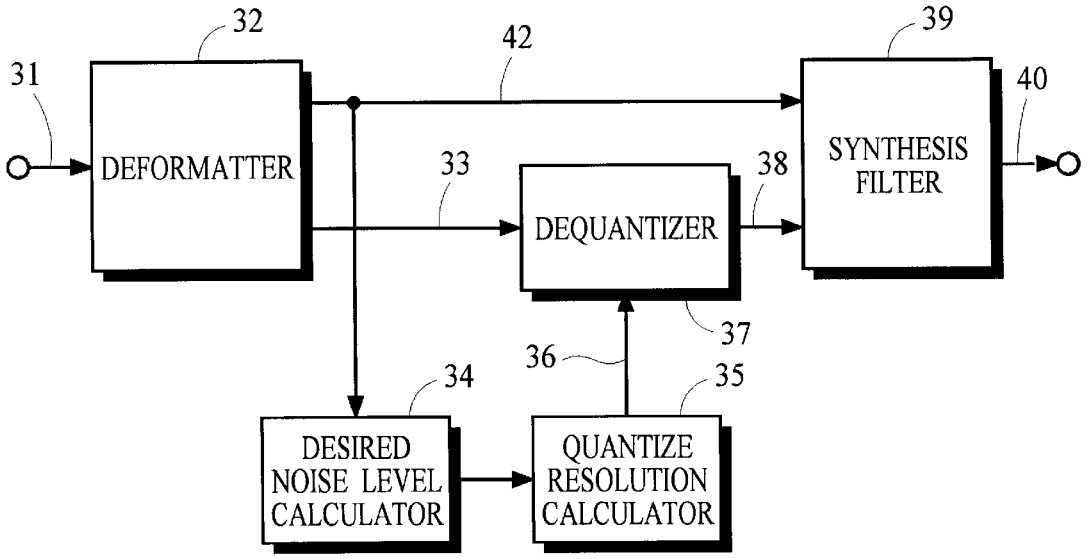

FIG. 2B illustrates another embodiment of a split-band decoder incorporating various aspects of the present invention that is similar to the embodiment discussed above. A few of the differences between these two embodiments are discussed here.

Deformatter 32 extracts quantized signals from an encoded signal received from path 31 and passes the quantized signals along path 33, and extracts information representing the encoded signal spectral envelope and pass this information along path 42. Deformatter 32 may also use an entropy decoder or other form of lossless decoder as necessary to reverse any lossless coding used to generate the encoded signal.

Desired noise level calculator 34 analyzes the spectral envelope information received from path 42, which obtains the desired noise level in response thereto. In response to the desired noise level received from desired noise level calculator 34, quantize resolution calculator 35 uses a noise-spreading model as explained above to determine the quantization resolutions that were used to generate the quantized signals and passes an indication of these resolutions along path 36.

Dequantizer 37 dequantizes the quantized signals received from path 33 according to the quantization resolution information received from path 36 and generates dequantized subband signals along path 38. Dequantizer 37 may be implemented and controlled as discussed above. A bank of synthesis filters 39 is applied to the dequantized subband signals and the spectral envelope information to generate an output signal along path 40.

The embodiment illustrated in FIG. 2B may be used in backward-adaptive coding systems because the information needed by the desired-noise-level calculator is conveyed in the encoded signal by the spectral envelope information. No additional information is needed. In another embodiment not shown, desired noise level calculator 34 provides a set of initial quantization resolutions and one or more modifications to these initial resolutions are obtained from the encoded signal by deformatter 32. These modifications may be applied to the initial quantization resolutions to provide noise-spreading compensation.

B. Filter Characteristics

As mentioned above, the principles of the present invention may be incorporated into embodiments of perceptual coding systems and methods that implement analysis and synthesis filters in a variety of ways. For ease of discussion, however, the following description makes more particular mention of TDAC transform embodiments. Efficient implementations of TDAC transforms are discussed in U.S. Pat. Nos. 5,297,236 and 5,890,106.

The quantization process in many perceptual coding systems determines the quantization resolution to use for quantizing a subband signal from the difference between the amplitude of the subband signal and the level of an estimated psychoacoustic masking threshold within that subband. An implicit assumption in this process is that the quantization noise for one transform coefficient is independent of the quantization noise for other neighboring transform coefficients. Generally, this assumption is not true because of the noise-spreading characteristics of the synthesis filters.

Figure 3:
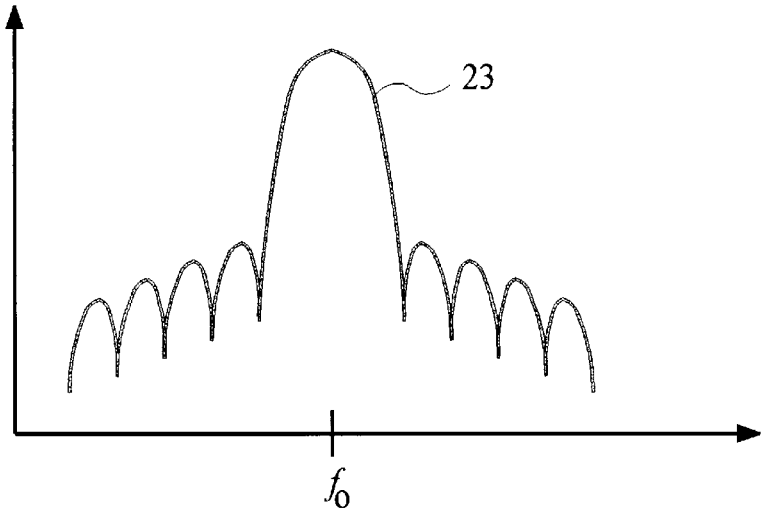
FIG. 3 is a schematic illustration of the frequency response for a hypothetical filter.

The degree of noise spreading is affected by the spectral selectivity of the synthesis filters. As explained above, the analysis and synthesis filters used in coding systems do not provide ideal passbands. A schematic illustration of the frequency response for a hypothetical synthesis filter is shown in FIG. 3. The response shown in the figure is a frequency-domain representation of a hypothetical output signal obtained from the synthesis filter in response to an input signal having a single spectral component at frequency $f_0$. The main lobe 23 of the frequency response that is centered at frequency $f_0$ is the filter passband. The smaller side lobes of the response are in the filter stopbands.

This spectral selectivity may be controlled by varying a number of factors including the length of the inverse transform and the shape of the synthesis window function. By varying the shape of the synthesis window function, the width of the passband can often be traded off against the level of attenuation provided in the stopbands. As the width of the main lobe is reduced to provide higher spectral selectivity, the attenuation in the stopbands is also reduced. The spectral selectivity can also be increased by increasing the length of the transform; however, the use of longer transforms is not always possible. In broadcast and other production applications that require real-time playback of the decoded signal, for example, a short length transform must be used to satisfy coding delay limitations. The noise-spreading characteristics of synthesis filters is particularly serious in such coding systems. Additional considerations for low-delay coding systems is discussed in U.S. Pat. No. 5,222,189.

The significance of noise-spreading is usually more serious for medium to low frequencies because the critical bands of the human auditory system are narrower at lower frequencies. Each critical band corresponds to the masking threshold for a spectral component within that band and represents the range of frequencies over which a dominant spectral component can likely mask other smaller spectral components like quantization noise. At lower frequencies, the masking threshold can become narrower than the frequency selectivity of the synthesis filter. This means it is more likely the synthesis filter will spread noise resulting from the quantization of a spectral component outside the masking threshold of that spectral component.

Figure 4A:
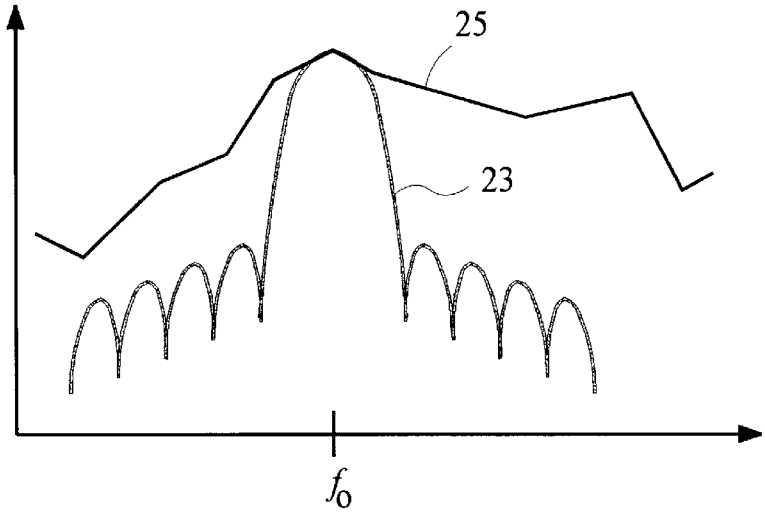
FIG. 4A is a schematic illustration of a perceptual masking threshold for a high-frequency spectral component as compared to the frequency response of FIG. 3.

FIG. 4A provides a schematic illustration of a perceptual masking threshold 25 for a high-frequency spectral component at frequency $f_0$ as compared to the filter frequency response illustrated in FIG. 3. As shown, masking threshold 25 for the high-frequency spectral component at frequency $f_0$ is wide enough to completely cover the synthesis filter response. This suggests that a relatively large amount of noise resulting from the quantization of the high-frequency spectral component at frequency $f_0$ that is spread by the synthesis filter is likely to be masked by the spectral component.

Figure 4B:
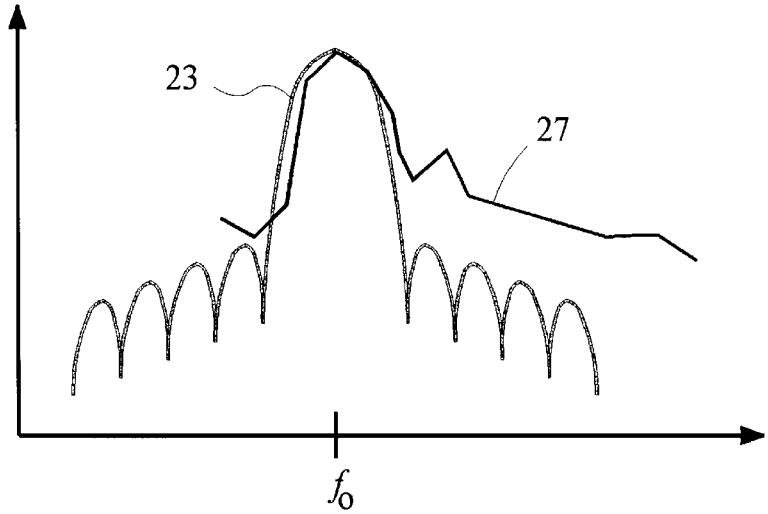
FIG. 4B is a schematic illustration of a perceptual masking threshold for a medium- to low-frequency spectral component as compared to the frequency response of FIG. 3.

FIG. 4B provides a schematic illustration of a perceptual masking threshold 27 for a medium- to low-frequency spectral component at frequency $f_0$ as compared to the filter frequency response illustrated in FIG. 3. As shown, the low-frequency side of masking threshold 27 for the lower-frequency spectral component at frequency $f_0$ does not cover the synthesis filter response. This suggests that only a relatively small amount of noise resulting from the quantization of the lower-frequency spectral component at frequency $f_0$ that is spread by the synthesis filter is likely to be masked by the spectral component.

C. Analytical Concepts

A quantization process according to the present invention takes into account the noise-spreading characteristics of the synthesis filters to establish quantization resolutions just fine enough to render the quantization noise inaudible. An explanation of an analytical basis for this process is provided in the following paragraphs.

1. Introduction

Figure 5:
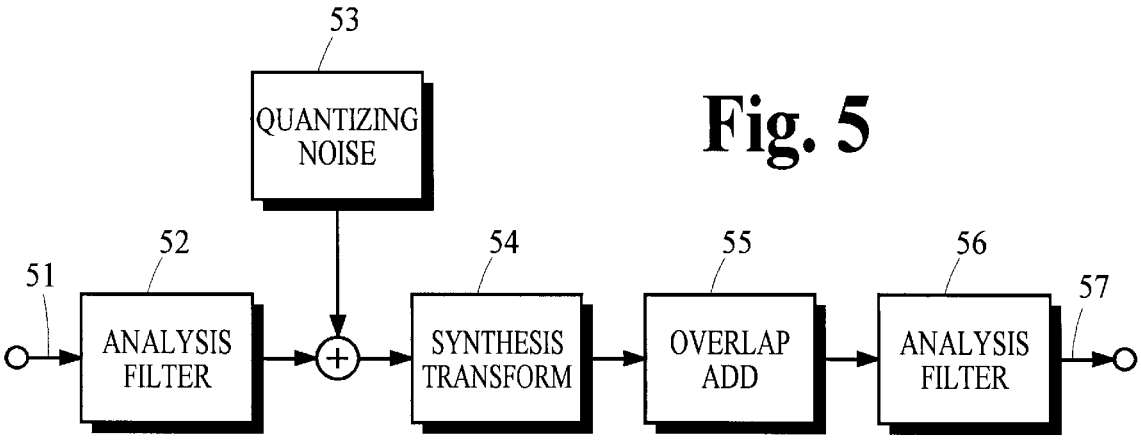
FIG. 5 is a block diagram of components illustrating concepts underlying some aspects of the present invention.

Referring to FIG. 5, analysis filter 52 represents a bank of analysis filters in a split-band encoder that generates transform coefficients constituting a frequency-domain representation of the audio signal received from path 51. Quantizing noise 53 represents a process that injects quantization noise into the frequency-domain representation obtained from analysis filter 52. Synthesis transform 54 and overlap-add 55 collectively represent a bank of synthesis filters in a split-band decoder. Synthesis transform 54 obtains a time-domain representation from the quantized frequency-domain representation of the audio signal. The process performed by overlap-add 55 overlaps adjacent blocks of samples in the time-domain representation obtained from synthesis transform 54 and adds corresponding samples in the overlapped blocks. Analysis filter 56 is a theoretical construct that is used to explain some principles of the present invention.

The bank of analysis filters 52 is implemented by suitable analysis window functions and the TDAC MDCT and is applied to a sequence of blocks of audio signal samples that are received from path 51 to generate subband signals in the form of a sequence of blocks of transform coefficients. This may be expressed as:

$$X_m(k) = \sum_{n=0}^{2M-1} w_A(n) \cdot x_m(n) \cdot \cos\left[\frac{2\pi(n+n_0)(k+k_0)}{2M}\right] \quad (1)$$

$$\text{for } 0 \le k < 2M,$$

where $X_m(k)$=transform coefficient k in transform coefficient block m;

$w_A(n)$=analysis window function at point n;

$x_m(n)$=signal sample n in signal sample block m;

$n_0$=a transform phase term required for aliasing cancellation;

$k_0$=a term which, for this particular TDAC transform, is equal to ½; and

2M=the length of the transform.

Quantizing noise 53 represents a process that adds noise to each transform coefficient by quantizing the transform coefficients according to a specified quantization resolution. This results in a quantized signal that includes a sequence of blocks of quantized transform coefficients. This may be expressed as:

$$\hat{X}_m(k)=X_m(k)+I_m(k) \text{ for } 0 \le k < M, \quad (2)$$

where $\hat{X}_m(k)$=quantized coefficient k in transform coefficient block m, and $I_m(k)$=quantization noise for coefficient k in transform coefficient block m.

Synthesis transform 54 is implemented by the TDAC inverse MDCT and suitable synthesis window functions, and is applied to the sequence of blocks of quantized transform coefficients to generate a sequence of blocks of time-domain samples. This may be expressed as:

$$\hat{x}_m(n) = \frac{1}{2M} \sum_{k=0}^{2M-1} \hat{X}_m(k) \cdot \cos\left[\frac{2\pi(k+k_0)(n+n_0)}{2M}\right] \quad (3)$$

$$\text{for } 0 \le n < 2M,$$

where $\hat{x}_m(n)$=recovered time-domain sample n in sample block m.

Figure 6:
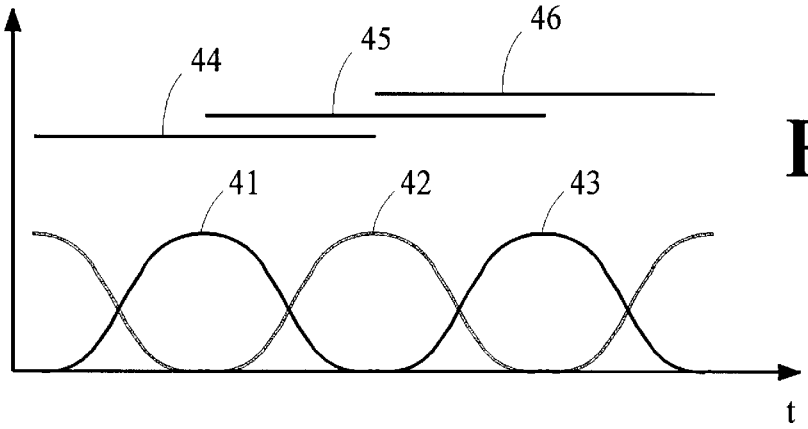
FIG. 6 is a schematic illustration of overlapping blocks of time-domain samples recovered by an inverse block transform and weighted by a synthesis window function.

Overlap-add 55 recovers a replica of the audio signal samples received from path 51 by applying a synthesis window function to each block of time-domain samples that is obtained from synthesis transform 54, overlapping the windowed blocks and adding corresponding time-domain samples in the overlapped blocks. The gain profile of a sequence of overlapping windowed blocks is shown in FIG. 6. Curve 41 illustrates the gain profile of a synthesis window function that is used to modulate a block of time-domain samples that is coextensive with line 44. Similarly, curves 42 and 43 illustrate the gain profiles of synthesis window functions that are used to modulate blocks of time-domain samples that are coextensive with lines 45 and 46, respectively. Signal samples representing a replica of the original audio signal samples within the interval illustrated by line 45 are obtained from the overlap-add process by adding the corresponding time-domain samples in the overlapping windowed blocks 41, 42 and 43. This may be expressed as:

$$\hat{y}_m(n)=\hat{X}(n)\cdot w_s(n)+\hat{x}_{m-1}(n)\cdot w_s(n+M)+\hat{x}_{m+1}\cdot w_s(n-M) \text{ for } 0 \le n < 2M, \quad (4)$$

where $\hat{y}_m(n)$=replica signal sample n in sample block m; and $w_s(n)$=synthesis window function at point n.

In embodiments using the TDAC transform, the analysis and synthesis window functions should be selected to satisfy those constraints necessary to provide aliasing cancellation. See the Princen paper cited above. Additional information pertaining to analysis and synthesis window functions may be obtained from U.S. Pat. No. 5,222,189 and from international patent application number PCT/US 98/20751 filed Oct. 17, 1998.

The bank of analysis filters 56 may be implemented by essentially any type of analysis filter. For purposes of illustration, this bank of analysis filters is implemented by a rectangular analysis window function and the TDAC MDCT discussed above for analysis filters 52. The bank of analysis filters 56 is applied to the replica signal samples to obtain a hypothetical frequency-domain representation of the replica signal, which is passed along path 57. The frequency-domain representation is used as a basis for an analytical expression of the noise-spreading characteristics of the synthesis filters. The representation may be expressed as follows:

$$\hat{Y}_m(k) = \sum_{n=0}^{2M-1} \hat{y}_m(n) \cdot \cos\left[\frac{2\pi(n+n_0)(k+k_0)}{2M}\right] \quad \text{for } 0 \le k < 2M, \tag{5}$$

where $\hat{Y}_m(k)$=transform coefficient k in the frequency-domain representation.

If quantization noise is not present in the input signal provided to synthesis transform 54, the blocks of time-domain samples obtained from equation 3 can be overlapped and added as shown in equation 4 to obtain a perfect reconstruction of the signal samples in the original input signal. This may be expressed as:

$$\hat{y}_m(n)=y_m(n)=x_m(n) \text{ for } 0 \le n < 2M. \tag{6}$$

The hypothetical frequency-domain representation obtained from analysis filter 56 for this perfect reconstruction may be expressed as:

$$Y_m(k) = \sum_{n=0}^{2M-1} y_m(n) \cdot \cos\left[\frac{2\pi(n+n_0)(k+k_0)}{2M}\right] \quad \text{for } 0 \le k < 2M. \tag{7}$$

2. Restatement of Quantization Problem

Using these two hypothetical frequency-domain representations obtained from analysis filter 56, an optimum quantization resolution for quantizing the frequency-domain representation obtained from analysis filter 52 can be expressed in terms of a process that controls the amplitude of the noise injected by quantizing noise 53 such that $$|\hat{Y}_m(k)-Y_m(k)|^2 \le N(k) \text{ for } 0 \le k < 2M, \tag{8}$$

where N(k)=a desired noise level for transform coefficient k.

The following assumptions are made for the quantization noise:

1. The quantization noise $I_m(k)$ for the various transform coefficients k are statistically independent.
2. The quantization noise $I_m(k)$ for various coefficient blocks m are statistically independent.
3. The quantization noise $I_m(k)$ in a respective coefficient block m have a mean that is equal to zero and have variances that are equal in consecutive coefficient blocks.

The first two assumptions are true for the coefficients obtained from the transforms generally used in audio coding systems. The third assumption is true for blocks of transform coefficients representing a stationary signal and is justified for quasi-stationary passages of music that are not quantized well by known perceptual coding systems and methods. In highly non-stationary passages for which the third assumption is not justified, errors caused by this assumption are generally benign and can be ignored.

3. Spreading Matrix

A process for quantization that takes proper account of synthesis filter noise spreading may be developed from an analytical expression of the relationship between the noise spectrum of the output signal obtained from the synthesis filter and the noise spectrum of the quantized input signal provided to the synthesis filter. A derivation of this analytical expression or "spreading matrix" will now be described.

First the expression for $\hat{x}_m(n)$ in equation 3 is substituted into equation 4, and the resulting expression for $\hat{y}_m(n)$ is then substituted into equation 5 to obtain an expression for the hypothetical frequency-domain representation of the synthesis filter output signal in terms of the quantized transform coefficients, as follows:

$$\hat{Y}_m(k) = \sum_{q=0}^{2M-1} A(k,q) \cdot \hat{X}_m(q) + B(k,q) \cdot \hat{X}_{m-1}(q) + C(k,q) \cdot \hat{X}_{m+1}(q) \tag{9a}$$

where $$A(k,q) = \frac{1}{M} \sum_{n=0}^{2M-1} w_s(n) \cdot \cos\left[\frac{2\pi(n+n_0)(k+k_0)}{2M}\right] \cdot \cos\left[\frac{2\pi(n+n_0)(q+q_0)}{2M}\right];$$

$$B(k,q) = \frac{1}{M} \sum_{n=0}^{2M-1} w_s(n+M) \cdot \cos\left[\frac{2\pi(n+M+n_0)(k+k_0)}{2M}\right] \cdot \cos\left[\frac{2\pi(n+n_0)(q+q_0)}{2M}\right];$$

$$C(k,q) = \frac{1}{M} \sum_{n=0}^{2M-1} w_s(n-M) \cdot \cos\left[\frac{2\pi(n-M+n_0)(k+k_0)}{2M}\right] \cdot \cos\left[\frac{2\pi(n+n_0)(q+q_0)}{2M}\right];$$

and $$q_0 = \frac{1}{2}; \quad \text{for } 0 \le k < 2M.$$

A similar expression may be obtained for the hypothetical frequency-domain representation of the synthesis filter output signal in terms of the unquantized transform coefficients by making a similar substitution into equation 7. The expression is:

$$Y_m(k) = \sum_{q=0}^{2M-1} A(k,q) \cdot X_m(q) + B(k,q) \cdot X_{m-1}(q) + C(k,q) \cdot X_{m+1}(q) \tag{9b}$$

By subtracting equation 9b from equation 9a, a hypothetical frequency-domain representation of the difference between these two output signals may be obtained, which can be represented as:

$$O_m(k) = \sum_{q=0}^{2M-1} A(k, q) \cdot I_m(q) + B(k, q) \cdot I_{m-1}(q) + C(k, q) \cdot I_{m+1}(q) \tag{10}$$

where $O_m(k)$=quantization noise in the synthesis filter output signal at frequency k; and $I_m(k)=\hat{X}_m(k)-X_m(k)$ for $0 \leqq k<2M$, as may be seen from equation 2. The expression in equation 10 may be used to rewrite expression 8 as follows:

$$|\hat{Y}_m(k)-Y_m(k)|^2=|O_m(k)|^2 \leqq N(k) \text{ for } 0 \leqq k<2M. \tag{11}$$

The matrices A, B and C have odd symmetry. These properties may be used to show that $$O_m(k)=-O_m(2M-1-k) \text{ for } 0 \leqq k<M; \tag{12}$$

therefore, equation 10 can be rewritten as:

$$O_m(k) = \sum_{q=0}^{M-1} A'(k, q) \cdot I_m(q) + B'(k, q) \cdot I_{m-1}(q) + C'(k, q) \cdot I_{m+1}(q) \tag{13}$$

where

A'(k, q)=2A(k, q);

B'(k, q)=2B(k, q); and

C'(k, q)=2C(k, q).

Under the three assumptions mentioned above that the components of the quantization noise have a zero mean, are statistically independent and are identically distributed, the noise power spectrum at the output of the synthesis filters can be obtained from equation 13 as follows:

$$\begin{aligned} N_{O,m}(k) &= E(|O_m(k)|^2) \\ &= \sum_{q=0}^{M-1} A''(k, q) \cdot N_{I,m}(q) + B''(k, q) \cdot N_{I,m-1}(q) + C''(k, q) \cdot N_{I,m+1}(q) \text{ for } 0 \le k < M, \end{aligned} \tag{14}$$

where

E(z)=the expected value of z;

$N_{O,m}(k)$=noise power at frequency k in the output of the synthesis filters;

$N_{I,m}(q)=E(|I_m(q)|^2)$;

$A''(k, q)=|A'(k, q)|^2$;

$B''(k, q)=|B'(k, q)|^2$; and $C''(k, q)=|C'(k, q)|^2$.

Under the third assumption mentioned above that the quantization noise variance is identical in consecutive coefficient blocks, equation 14 can be simplified to:

$$N_{O,m}(k) = \sum_{q=0}^{M-1} W(k, q) \cdot N_{I,m}(q) \text{ for } 0 \le k < M, \tag{15}$$

where W(k, q)=A"(k, q)+B"(k, q)+C"(k, q). The W matrix is the spreading matrix referred to above.

4. Optimum Quantization Resolution

Referring to expressions 8, 11, 14 and 15, it can be seen that an optimum quantization resolution results in a quantizing noise spectrum $\{N_{I,m}(q)\}$ for $0 \leqq q<M$ such that $$N_{O,m}(k) = \sum_{q=0}^{M-1} W(k, q) \cdot N_{I,m}(q) \le N(k) \text{ for } 0 \le k < M. \tag{16}$$

For equality with the desired noise, a direct solution is $$N_{I,m}(k) = \sum_{q=0}^{M-1} W^{-1}(k, q) \cdot N(q) \text{ for } 0 \le k < M. \tag{17}$$

Unfortunately, this direct solution often yields negative solutions for one or more transform coefficients k, which means the slope of the desired noise level N(k) is so steep that negative amounts of noise must be injected into the quantization process to achieve the spectral shape of the desired noise. It is not possible in practical embodiments to inject negative amounts of noise into the quantization process. Fortunately, expression 16 need not be solved for equality. An acceptable quantization resolution can be realized if it satisfies the inequality.

Figure 8:
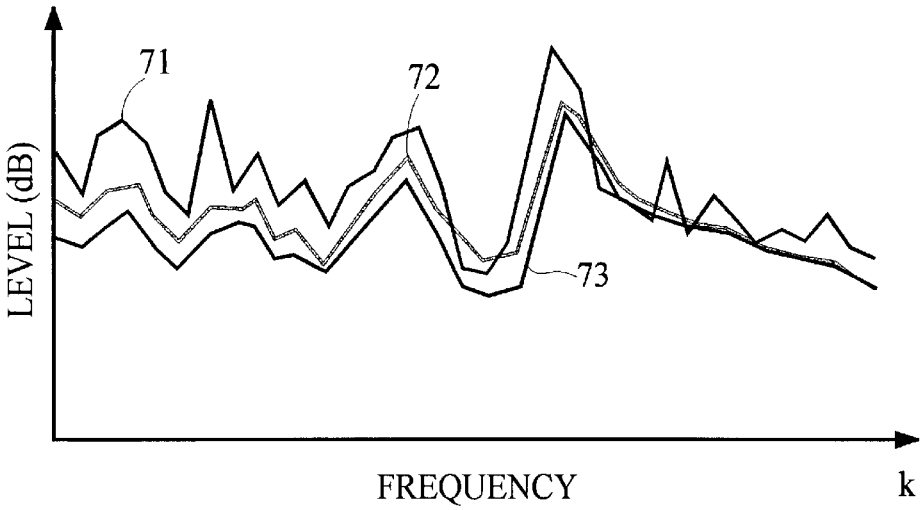
FIG. 8 is a graphical illustration of a smoothed power spectrum, a desired noise spectrum, and a quantizing noise spectrum for a hypothetical audio signal.

To achieve a solution, the quantizing noise spectrum can be rewritten in terms of the desired noise spectrum as follows $$N_{I,m}(k)=g(k) \cdot N(k) \text{ for } 0 \leqq k<M, \tag{18}$$

where g(k)=a gain factor. A graphical illustration of a hypothetical example of noise spectra and gain factors is shown in FIG. 8 in which curve 71 is a smoothed measure of spectral power for a block m of transform coefficients $X_m(k)$ representing an audio signal, curve 72 is the desired noise spectrum N(k), and curve 73 is a quantizing-noise spectrum $N_{I,m}(k)$ for the transform coefficients in block m that is obtained by multiplying the desired noise spectrum by gain factors g(k). As shown in the figure, it is anticipated that the gain factors are normally in the range from zero to one.

a) Two-Dimensional Example

For ease of illustration, a two-dimensional example (M=2) will be used to explain how the gain factors can be used. By substituting equation 18 into expression 16, it can be seen that $$N(\mathbf{0}) \geqq W(\mathbf{0},\mathbf{0}) \cdot g(\mathbf{0}) \cdot N(\mathbf{0}) + W(\mathbf{0},\mathbf{1}) \cdot g(\mathbf{1}) \cdot N(\mathbf{1}) \tag{19a}$$

and $$N(\mathbf{1}) \geqq W(\mathbf{1},\mathbf{0}) \cdot g(\mathbf{0}) \cdot N(\mathbf{0}) + W(\mathbf{1},\mathbf{1}) \cdot g(\mathbf{1}) \cdot N(\mathbf{1}), \tag{19b}$$

where $$0<g(\mathbf{0}) \leqq 1 \text{ and } 0<g(\mathbf{1}) \leqq 1. \tag{19c}$$

Although $g(\mathbf{0})=g(\mathbf{1})=0$ always satisfies the two inequalities, this particular solution is not acceptable because each zero value of gain factor implies the respective transform coefficient must be quantized with infinite precision. Preferred solutions yield values for the gain factors that are as close to one as possible. Indeed, if a solution can be realized with all gain factors having a value of one, no compensation is needed for synthesis filter noise spreading.

The search for gain factor values that provide an optimal solution can be framed as a linearly constrained optimization problem that seeks to minimize the cost of the compensation. In many embodiments, it is convenient to increase the cost of compensation as the logarithm of the amount by which the quantizing noise spectrum is reduced. In a preferred embodiment that uses bit allocation to control quantization resolution, the cost is equal to one bit per transform coefficient for each −6.02 dB the quantizing noise spectrum is changed. For example, if gain factor g(1) is set equal to 0.25, then $N_{I,m}$(1) of the quantizing noise spectrum is changed by −12.04 dB with respect to N(1) of the desired noise spectrum. The cost for this noise-spreading compensation of transform coefficient X(1) is (−12.04 dB/−6.02 dB)=2 bits.

For embodiments like the ones just described that have a logarithmic cost function, the desired quantization noise spectrum shown in equation 18 can be conveniently represented as $$\log N_{I,m}(k)=\log g(k)+\log N(k) \text{ for } 0\leqq k<M. \tag{20}$$

The cost of compensation varies inversely with the logarithm of each gain factor. Thus, the total cost of compensation in this two-dimensional example is proportional to −log g(0)−log g(1). For ease of discussion, the constant of proportionality is assumed herein to be equal to one. The goal of the optimization problem is to minimize the cost of compensation under the constraints imposed by expressions 19a, 19b and 19c.

The first step in framing quantization as a linear optimization problem is to replace each N(j)·W(i, j) term in expressions 19a and 19b with an element D(i, j) of a matrix D. All elements in matrix D are known to be positive because each element represents the product of two positive quantities. The results of this replacement may be expressed as $$N(\mathbf{0})\geqq D(\mathbf{0},\mathbf{0})\cdot g(\mathbf{0})+D(\mathbf{0},\mathbf{1})\cdot g(\mathbf{1}) \tag{21a}$$

and $$N(\mathbf{1})\geqq D(\mathbf{1},\mathbf{0})\cdot g(\mathbf{0})+D(\mathbf{1},\mathbf{1})\cdot g(\mathbf{1}), \tag{21b}$$

where $$0<g(\mathbf{0})\leqq 1 \text{ and } 0<g(\mathbf{1})\leqq 1. \tag{21c}$$

Figure 7:
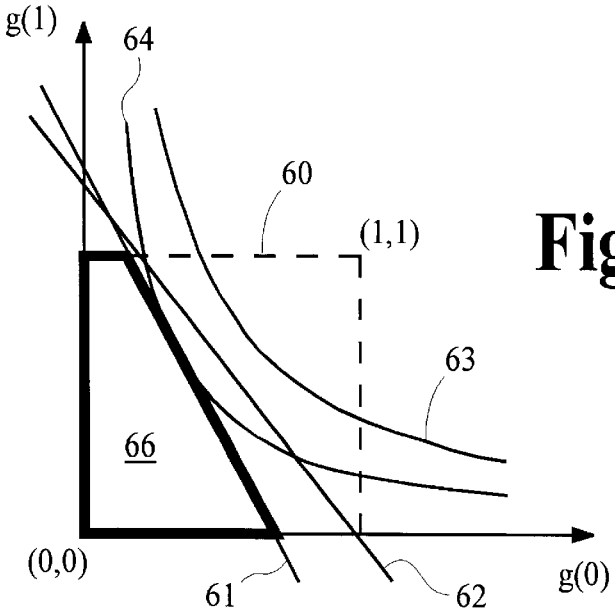
FIG. 7 is a geometrical illustration of an optimization problem that seeks an optimum quantization resolution.

The optimization problem expressed in this manner can be illustrated geometrically in a g(0), g(1) coordinate space as shown in FIG. 7. The region 60 of possible solutions to the optimization problem is restricted to a unit square in quadrant I of the coordinate space that has sides corresponding to the minimum and maximum values permitted for the two gain factors as shown in expression 21c. In the example shown, the region on the side of straight line 61 that includes the origin represents the portion of the space that satisfies the inequality in expression 21a, and the region on the side of straight line 62 that includes the origin represents the portion of space that satisfies the inequality in expression 21b. Solution space 66, represented by the intersection of these three regions, is the portion of the g(0), g(1) coordinate space in which the solution for the optimization problem may be found that satisfies all of the conditions imposed by expressions 21a, 21b and 21c. The boundary of solution space 66 is shown with a wide line that, in this example, forms an irregular quadrilateral with sides congruent with portions of the g(0) and g(1) axes, line 61, and the top of the unit square that is region 60.

If the solution space includes the (1,1) coordinate, the optimum quantization resolution is obtained by setting all gain factors equal to one because no compensation is required for synthesis filter noise spreading. Referring to FIG. 8, this is equivalent to setting the quantizing noise spectrum 73 equal to the desired noise spectrum 72 throughout the range of transform coefficients from k=0 to k=(M−1). If the (1,1) coordinate is not within the solution space, a process can be used to find the optimum quantization resolution by finding an optimum set of gain factors within the solution space in which one or more gain factors have a value less than one. This is equivalent to obtaining a quantizing noise spectrum 73 that is lower than the desired noise spectrum 72 for one or more transform coefficients.

The optimum set of gain factors minimizes the cost of compensation K, which is calculated from the equation $$K=-\log g(\mathbf{0})-\log g(\mathbf{1}). \tag{22}$$

This equation defines a hyperbolic line in the g(0)−g(1) coordinate space and represents a locus of values for the two gain factors that correspond to a constant cost K of noise-spreading compensation. For example, hyperbolic line 63 represents a contour for some cost of compensation $K_1$ and hyperbolic line 64 represents a contour for another cost of compensation that is higher than $K_1$. As the cost of compensation approaches infinity, the corresponding constant-cost contour approaches the two coordinate axes.

As stated above, the goal of the optimization problem is to find a minimum-cost solution that satisfies expressions 21a, 21b and 21c. The optimum solution may be obtained by finding the lowest-cost hyperbolic contour that intersects the solution space. In the example shown in FIG. 7, the optimum solution occurs at the point of tangency between hyperbolic contour 64 and the boundary of solution space 66.

b) Higher Dimensions

Practical perceptual coding systems and methods utilize filters that require the quantization process to solve an optimization problem that has many more dimensions than two. This problem can be stated as finding the set of gain factors {g(k)} within the solution space that satisfies the inequalities $$N(k)\geq\sum_{q=0}^{M-1}W(k,q)\cdot g(q)\cdot N(q)=\sum_{q=0}^{M-1}D(k,q)\cdot g(q) \tag{23}$$

within a unit hypercube defined by $$0<g(k)\leqq 1 \text{ for } 0\leqq k<M \tag{24}$$

such that the compensation cost K is $$K=\min\left[\sum_{k}-\log g(k)\right]. \tag{25}$$

For example, if a TDAC transform of length 256 is used, the optimization problem has M=128 dimensions. In this example, the region of possible solutions is limited to a hypercube having vertices with coordinates corresponding to gain factors having values equal to either zero or one. The solution space for the optimization problem is that portion of the hypercube that is between the coordinate axes and the hyperplanes closest to the origin. The optimum minimum-cost solution is found at the point of tangency between a hyperbolic constant-cost hypersurface and the boundary of the solution space.

Figure 9:
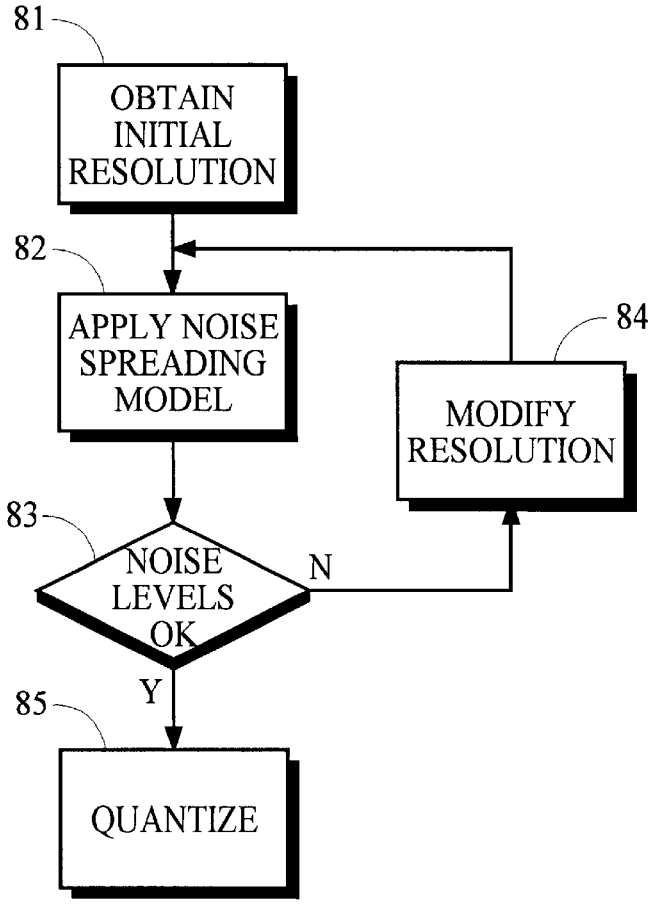
FIG. 9 is a flowchart illustrating steps in a reiterative process for determining quantization resolutions.

A substantially optimum set of quantization resolutions may be obtained in a reiterative process such as that shown in FIG. 9. Step 81 obtains a set of initial quantization resolutions and step 82 applies a synthesis-filter spreading model to the initial resolutions to calculate the resultant noise levels. Step 83 compares the calculated resultant noise levels with the desired noise levels. If the results of the comparison are not acceptable, step 84 modifies the quantization resolutions appropriately and step 82 applies the noise-spreading model to the modified resolutions. For example, if the calculated resultant noise level for a signal component is too low, the quantization resolution for one or more signal components is made more coarse. If the calculated resultant noise level for a signal component is too high, the quantization resolution for one or more signal components is made more fine. This process continues until the results of the comparison performed in step 83 are acceptable. Subsequently, step 85 quantizes signal components according to the quantization resolutions that provided the acceptable comparison.

Essentially any set of initial quantization resolutions may be used; however, processing efficiency is generally improved by choosing initial resolutions that are close to the optimum values. One convenient choice for the initial resolutions are those resolutions that correspond to the desired noise levels.

A quantization process may be carried out by a bit-allocation process that performs the following steps:

1. Determine a tentative bit allocation by calculating the desired noise power for each transform coefficient using equation 17. The tentative bit allocation Q(k) for each transform coefficient X(k) is obtained from the logarithm of the signal power and the negative logarithm of the respective desired noise power level. For example, in one embodiment the bit allocation is $$Q(k) = \frac{10 \cdot (2 \cdot \log|X(k)| - \log N_{l,m}(k))}{6.02}.$$

2. If the tentative bit allocation for all coefficients is positive, the bit allocation process is complete and the transform coefficients are quantized according to the tentative bit allocations because no compensation for synthesis filter noise spreading is needed.
3. If the tentative bit allocation obtained from step 1 is negative for any transform coefficient, noise-spreading compensation is required. The bit allocation process continues by defining the unit hypercube according to expression 24.
4. Find the intersection of the regions in hyperspace that satisfy the inequalities of expression 23. This may be accomplished more efficiently by including only the hyperplanes defined by the rows in matrix D that are closest to the origin. The distance d for each hyperplane can be determined from $$d = \frac{N(i)}{\sqrt{(D(i,0))^2 + (D(i,1))^2 + \cdots (D(i,M-1))^2}}.$$

One hyperplane may be closest to the origin in part of the hyperspace and one or more other hyperplanes may be closest to the origin in other parts of the hyperspace.

5. Determine the solution hyperspace from the intersection of the hypercube defined in step 3 and the intersection of regions found in step 4.
6. Select an initial compensation cost K.
7. Determine whether the constant-cost hyperbolic hypersurface for cost K intersects the solution hyperspace determined in step 5.
8. If the hyperbolic hypersurface for cost K is tangent to the boundary of the solution hyperspace, the bit allocation is complete. The number of additional bits required for each transform coefficient X(k) to provide an optimum compensation for noise spreading is obtained from the negative logarithm of the respective gain factor. For example, in one embodiment the bit allocation for each coefficient is $$Q(k) = \frac{10 \cdot (2 \cdot \log|X(k)| - \log g(k) - \log N_{l,m}(k))}{6.02}.$$

9. If the hyperbolic hypersurface does not intersect the solution hyperspace, select a cost higher than the current cost K and continue with step 7.
10. If the hyperbolic hypersurface does intersect the solution hyperspace, select a cost lower than the current cost K and continue with step 7.

D. Simplified Processes

Considerable computational resources are required to carry out the optimization process described above. In some applications, the cost required to provide these computational resources is too great; therefore, simplified processes that provide approximations to the optimum solution are desirable for these applications. A few embodiments of simplified processes that use bit allocation to control quantization resolution are described below. Each of these processes assume an initial bit allocation has been determined for each transform coefficient without regard to compensation for synthesis filter noise spreading in an attempt to obtain a quantizing noise spectrum that is substantially equal to the desired noise spectrum. Given this initial bit allocation, each process identifies those transform coefficients whose bit allocations should be increased to obtain the desired noise levels.

1. First Simplified Process

A first simplified process uses a metric function to estimate the total noise level for each transform coefficient X(k) one at a time, starting with the lowest-frequency transform coefficient X(0), and determines whether noise spreading causes the total noise for that coefficient to exceed the desired noise level N(k). If the estimate indicates the total noise level for the current coefficient X(k) does not exceed the desired noise level, the process continues with the next higher-frequency transform coefficient.

If the estimate indicates the total noise level for the current coefficient X(k) does exceed the desired noise level N(k), the coefficient that makes the largest contribution to the noise level of coefficient X(k) is identified and the gain factor g(k) for that coefficient is set to a prescribed value, say −144 dB which in one embodiment represents a compensation of 24 bits. The metric function is used to estimate the total noise level for coefficient X(k) that results with the adjusted bit allocation. If the estimated noise level still exceeds the desired noise level N(k), the coefficient making the next largest contribution to the noise level of coefficient X(k) is identified, its gain factor is set to the prescribed value, and the metric function is used again to estimate the new noise level. This continues until the estimated noise level is reduced to a level at or below the desired noise level.

At this point, there exists a set {S} of coefficients having gain factors that were set to the prescribed value to reduce the estimated noise level for coefficient X(k). The gain factors for the coefficients in the set {S} are adjusted according to a formula to provide what is anticipated to be just enough compensation for noise spreading. The bit allocation process then continues with the next higher-frequency transform coefficient.

An embodiment that implements this first simplified process is shown in the following program fragment. This program fragment is expressed in pseudo-code using a syntax that includes some syntactical features of the C, FORTRAN and BASIC programming languages. This program fragment and other program fragments described herein are not intended to be source code segments suitable for compilation but are provided to convey a few aspects of possible implementations.

```
Compensate ( W, N ) {
    for ( k=0 to MaxC ) g[k] = 1.0;          //initialize gain factors
    for ( k=0 to MaxC ) {                    //for each coefficient k . . .
      S = Null;      //set S is empty
                //calculate noise level
      metric = N[k] - Sum ( W[k, i] * g[i] * N[i]; for ( i=k-L1 to k+L2 ) );
      if ( metric < 0) {          //if too much noise . . .
        while ( metric < 0 ) {   //until noise level OK . . .
                //find maximum contributor to noise
          k_max = Max ( W[k, i] * g[i] * N[i]; for ( i=0 to M2-1 ) );
          g[k_max] = max_correction;     //make prescribed correction
          S = Union ( S, k_max );        //add max contributor to the set
                //calculate new noise level
          metric = N[k] + Sum ( W[k, i] * g[i] * n[i]; for ( i=k-L1 to k+L2 ) );
        }
        g_new = Adjust ( W, N[k], S, g ); //adjust gain factors by formula
        for each i in S
          g[i] = min ( g[i], g_new );
      }
    }
}
```

The routine Compensate is provided with array W that is the spreading matrix for a bank of synthesis filters, and array N specifying the desired noise spectrum. Gain factors in array g are initialized to a value of 1.0 for the low-frequency coefficients of interest from k=0 up to k=MaxC. Compensation is not needed for the highest-frequency coefficients in many embodiments.

A main for-loop constitutes the remainder of the Compensate routine and carries out the compensation process for each of the low-frequency coefficients of interest. The Null function is invoked to initialize an array S to an empty or null state. The variable metric is assigned an estimate of the noise level for the current coefficient k by invoking the function Sum to calculate the sum $$\sum_{i=k-L1}^{k+L2} W(k, i)\cdot g(i)\cdot N(i) \quad \text{for } 0 \le i < M2,$$

where M2=length of the synthesis filter transform, and by subtracting this sum from the desired noise level N[k] for the coefficient k.

The limits L1 and L2 of the summation significantly affect the computational complexity of this process; the order of complexity for routine Compensate is $(L1+L2)^2$. Computational efficiency can be improved by adjusting the values of L1 and L2 to limit the range of coefficients included in the calculation. The value for these limits can be determined empirically. In an alternative simplified process discussed below, these limits conform to the range of non-zero elements in a sparse version of array W.

If the estimated noise level is less that the desired noise level, metric is positive and no compensation for noise spreading is needed. Therefore, if metric is positive, the remainder of the for-loop is skipped and processing continues for the next coefficient.

If metric is negative, processing continues with a while-loop that continues until metric becomes positive. Within this while-loop, the function Max is invoked to determine the coefficient k_max that makes the largest contribution to the noise for coefficient k. This is accomplished by finding the index i that corresponds to the maximum value for the product W[k, i]*g[i]* N[i] for i from 0 to M2−1. This range for the index i includes all transform coefficients for the system. If desired, processing efficiency can be improved by limiting the search for the maximum product to a narrower range of coefficients. This range can be determined empirically. When the maximum contributor is found, the gain factor for k_max is assigned a prescribed value max_correction that corresponds to some maximum amount of compensation. In one embodiment, the maximum amount of compensation is −144 dB, which corresponds to 24 bits. After invoking the function Union to add k_max to the array S, an estimate of the noise level is calculated again using the revised gain factor for k_max and is assigned to the variable metric. The while-loop continues until the value of metric becomes positive.

When compensation has been applied to enough of the maximum contributors, the estimated noise level for coefficient k will be reduced to a value less than or equal to the desired noise level N[k] and the variable metric becomes positive. When this occurs, the while-loop terminates and processing continues by invoking the function Adjust to calculate a tentative new value g_new for the gain factors of the coefficients represented in array S, which correspond to the coefficients in set {S} discussed above. These new values are intended to optimize the level of compensation so that the estimated noise level is substantially equal to the desired noise level. This may be accomplished by performing the following calculation:

$$g_\text{new} = N(k) - \frac{\sum W(k, i)\cdot g(i)\cdot N(i) \ \text{ for } i \notin \{S\}}{\sum W(k, i)\cdot N(i) \ \text{ for } i \in \{S\}}.$$

Each gain factor for the coefficients represented in array S is set to the tentative value g_new if the tentative value is less than the current value of the respective gain factor.

The main for-loop in the compensation process continues with the next transform coefficient until all coefficients of interest have been processed.

2. Variations of the First Simplified Process

The first simplified process discussed above can be modified in a variety of ways to improve processing efficiency. A few ways are mentioned briefly above.

One variation attains a significant reduction in computational complexity by recognizing that a few elements in a typical spreading matrix array W are significantly larger than all other elements, and that good performance can be realized even when many of these smaller elements are set to zero.

Figure 10:
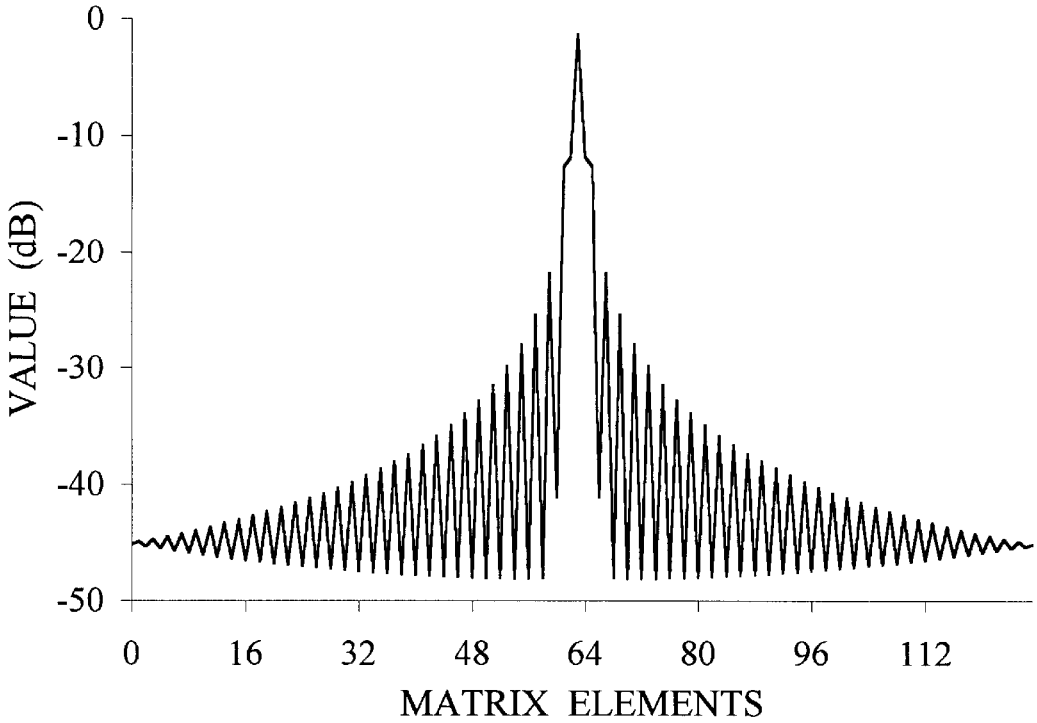
FIG. 10 is a graphic illustration of values of the members in a central row of a spreading matrix.

FIG. 10 illustrates the values of the elements in the center row of a hypothetical spreading matrix. The dominant value in the center corresponds to the element on the main diagonal of the matrix. Elements on and near the main diagonal have values that are significantly larger than those elements that are away from the main diagonal. This characteristic allows the spreading matrix to be represented reasonably well by a sparse diagonal-band array and the values for L1 and L2 in the program fragment discussed above can be reduced to cover only the non-zero elements of the array. This characteristic also reduces the range over which a search is made for maximum contributors.

Another variation improves processing efficiency by eliminating the while-loop in the embodiment discussed above. Efficiency is improved by eliminating a reiterative process in which the maximum noise contributor is determined and a tentative new value for the gain factors is calculated. An embodiment of this variation is shown in the following program fragment:

```
Compensate ( W, N ) {
    for ( k=0 to MaxC ) g[k] = 1.0;   //initialize gain factors
    for ( k=0 to MaxC ) {             //for each coefficient k . . .
                  //calculate noise level
      metric = N[k] − Sum ( W[k, i] * g[i] * N[i]; for ( i=k−L1 to k+L2 ) );
      if ( metric < 0 ) {     //if too much noise . . .
                  //find maximum contributor to noise
        k_max = Max ( W[k, i] * g[i] * N[i]; for ( i=0 to M2−1 ) );
        for ( i=−L1 to L2 )
          g[k_max+i] = g[k_max+i] * comp[i];
      }
    }
}
```

In this variation, the routine Compensate is provided with the array W and the array N as described above. Gain factors in array g are initialized to a value of 1.0 for the low-frequency coefficients of interest from k=0 up to k=MaxC. Compensation is not needed for the highest-frequency coefficients in many embodiments.

The main for-loop constitutes the remainder of the routine and carries out the compensation process for each of the low-frequency coefficients of interest. The variable metric is assigned a value estimating the noise level for the current coefficient k as described above.

If the estimated noise level is less that the desired noise level, metric is positive and no compensation for noise spreading is needed. Therefore, if metric is positive, the remainder of the for-loop is skipped and processing continues for the next coefficient.

If metric is negative, the bit allocation for one or more transform coefficients is increased to account for noise spreading by finding the largest contributor k_max to the estimated noise and by applying a predetermined amount of correction to transform coefficient k_max and a few neighboring coefficients. The maximum contributor is determined by invoking the function Max, as described above, and the predetermined corrections are applied by reducing the values of the gain factors for coefficients −L1 to L2 by multiplying each gain factor by a respective value in the array comp. For example, the gain factor g[k_max] may be reduced to indicate a 2-bit increase in allocation, the gain factors g[k_max−1] and g[k_max+1] may be reduced to indicate a 1.5-bit increase in allocation, and the gain factors g[k_max−2] and g[k_max+2] may be reduced to indicate a 1-bit increase in allocation. The degree of predefined correction may be determined empirically for each application.

The main for-loop in the compensation process continues with the next transform coefficient until all coefficients of interest have been processed.

Another embodiment of this variation is shown in the following program fragment.

```
Compensate ( w, n ) {
    for ( k=0; k<16; k++ )
      g[k] = 0;    //initialize gain factors to 0 dB, meaning no correction
    for ( k=0, k<11, k++ ) {            //for each coefficient of interest . . .
        //check which coefficients need compensation and, if so,
        //which coefficient is the maximum noise contributor
      est_noise = w[k][k] + n[k];       //initialize estimated noise level for k
      contrib[L] = est_noise;           //contribution of coefficient k to itself
      k_max = L;                        //initialize index and . . .
      max_contrib = est_noise;          //contribution for max contributor
      for ( j=k-L; j<=k+L; j++ ) {      //check contribution of other coefficients j
        if ( ( j>=0 ) && ( j<>k ) ) {          //omit negative coeff and coeff k
          contrib[j-k+L] = w[k][j] + n[j];     //contribution from coefficient j
          if ( contrib[j-k+L] > max_contrib ) {    //if this is max so far . . .
            k_max = j-k+L;                     //update index and . . .
            maxcontrib = contrib[j-k+L];       //contribution of max contributor
          }
          est_noise = LogAdd( est_noise, contrib[j-k+L] ); //add log values
        }
      }
        //apply correction only if desired noise is less than estimated noise
      if ( n[k] < est_noise ) {
        for ( j = -L; j<=L; j++ )
          if (k_max+k-j > 0 )                  //omit negative coefficients
            g[k_max+k-j] += comp[j];                //apply compensation
      }
    }
    for ( k=0; k<16; k++ ) {
      alloc[k] = max( 0, n[k]+g[k] );          //prepare allocation array
    }
}
```

Unlike the examples discussed above, the spreading matrix, the gain factors and the noise levels are expressed in decibels; therefore, a function LogAdd is used to provide the sum of two logarithmic values. The noise contribution of coefficient j to coefficient k is represented by the expression w[k][j]+n[j], which represents the product of the desired noise level for coefficient j with a respective element of the spreading matrix. Each element k of array alloc represents the desired quantization noise in decibels for coefficient k.

3. Second Simplified Process

A second simplified process provides noise-spreading compensation in two steps. The first step determines an initial amount of compensation by taking each respective transform coefficient X(k) one at a time, starting with the lowest-frequency coefficient X(0), identifying the neighboring coefficients X(j) that make individual contributions to the estimated noise level of the respective coefficient that exceed the desired noise level N(k) for that coefficient, and determining the initial amount of compensation for those neighboring coefficients X(j) such that their respective individual contributions are reduced to the desired noise level. The second step reiteratively refines the compensation to bring the total noise contribution for each respective transform coefficient to the desired noise level.

An embodiment that implements this second simplified process is shown in the following program fragment.

```
Compensate ( W, N ) {
    for ( i=0 to M-1 ) compN[i] = N[i];   //initialize compensation array
    compOK = False;                       //initialize for the while loop
    while (compOK = False ) {
      compOK = True;                      //assume compensation will be sufficient
      for ( i=0 to M-1 )                  //STEP1 . . .
        tempN[i] = compN[i];              //initialize temp array
      for ( k=0 to M-1 ) {                // for each respective coefficient . . .
        k_max = 0;                        //initialize index and . . .
        max_contrib = W[k, 0] * tempN[0]; //contributin for max contributor
        for ( j=1 to M-1 ) {              //for each neighboring coefficient . . .
          if ( max_contrib < W[k, j] * tempN[j] ) {      //if new max . . .
            k_max = j;                        //update index and value for . . .
            max_contrib = W[k, j] * tempN[j];    //max contributor
          }
        }
        if ( max_contrib > tempN[k] )    //if maximum contribution . . .
                //exceeds temp noise, change compensatin by same amount
          compN[k_max] = compN[k_max] * tempN[k_max] / max_contrib;
      }
      for ( k=0 to M-1 ) {                //STEP2-for each respective coefficient . . .
        totalN = Sum ( W[k, j] * compN[j]; for ( j=0 to M-1 ) );
```

-continued

```
        if ( N[k] < totalN ) {          //if total contribution is too high . . .
          compN[k] = compN[k] * N[k] / totalN; //change compensation
          compOK = False;               //reiterate the process
        }
      }
    }
}
```

The routine Compensate is provided with the array W and the array N as described above. An array compN of compensation values is initialized from the array N of desired noise and a variable compOK is initialized so that the following while-loop executes at least once. The while-loop constitutes the remainder of the Compensate routine and carries out the compensation process in two steps. The loop first initializes the variable so that the while-loop will terminate unless excessive level noise is calculated in the second step.

The portion of the routine that performs the first step initializes an array tempN of temporary calculations and executes a for-loop in which the noise contributions to each coefficient k is examined one at a time. After initializing the variables k_max and max_contrib to the coefficient j=0, a nested for-loop is used to calculate the estimated noise contribution W[k, j]*tempN[j] and determine if it is the maximum contribution calculated thus far. If not, the nested loop continues with the next coefficient j. If this estimated noise contribution is the largest level calculated thus far, the variables k_max and max_contrib are changed to reference the current coefficient j. After the nested loop examines the contributions for all coefficients, if the maximum noise contribution max_contrib exceeds the desired noise level N[k], the respective member of the compensation array compN[k] is changed by the same amount that the maximum contribution exceeds the desired noise level. The processing in the first step continues with the next coefficient until all coefficients have been processed.

The portion of the routine that performs the second step calculates an estimate of the total noise for each coefficient k and compares this estimate with the desired noise level N[k]. If the estimate exceeds the desired noise level, compensation compN[k] for the respective coefficient k is reduced by the same amount the desired noise level is exceeded by the estimated total noise. The variable compOK is set so that the first and second steps are performed again.

The main while-loop continues until the first and second steps can be performed without causing the compOK variable to be set to False.

An alternative embodiment implementing the second simplified process is shown in the following program fragment.

```
Compensate ( W, N ) {
    for ( i=0 to M−1 ) compN[i] = N[i];   //initialize compensation array
    compOK = False;                       //initialize for the while loop
    while (compOK = False) {
      compOK = True;                      //assume compensation will be sufficient
      for ( i=0 to M−1 )                  //STEP1 . . .
        tempN[i] = compN[i];              //initialize temp array
      for ( k=0 to M−1 ) {                // for each respective coefficient . . .
        k_max = k;                        //initialize index and . . .
                                          //contribution for max contributor
        max_contrib = W[k, k_max] * tempN[k_max];
        for ( j=k−L1 to k+L2 ) {          //for each neighboring coefficient . . .
          if ( j<>k) {
            if ( max_contrib < W[k, j] * tempN[j] ) {    //if new max . . .
              k_max = j;                  //update index and value for . . .
              max_contrib = W[k, j] * tempN[j]; //max contributor
            }
          }
        }
        if ( max_contrib > tempN[k] )     //if maximum contribution . . .
                  //exceeds temp noise, change compensation by same amount
          compN[k_max] = compN[k_max] * tempN[k_max] / max_contrib;
      }
      for ( k=0 to M−1 ) {                //STEP2-for each respective coefficient . . .
        totalN = Sum ( W[k, j] * compN[j]; for ( j=0 to M−1 ) );
        if ( N[k] < totalN ) {            //if total contribution is too high . . .
          compN[k] = compN[k] * N[k] / totalN;    //change compensation
          compOK = False;                 //reiterate the process
        }
      }
    }
}
```

The execution of this routine requires lower computational resources because the for-loop that identifies the maximum contributor max_contrib to the noise for a given coefficient j examines a narrow band of neighboring coef ficients on either side of coefficient j from j−L1 to j+L2, excluding the coefficient j itself, rather than examine the entire spectrum as is done in the program fragment discussed above.

E. Implementation

Figure 11:
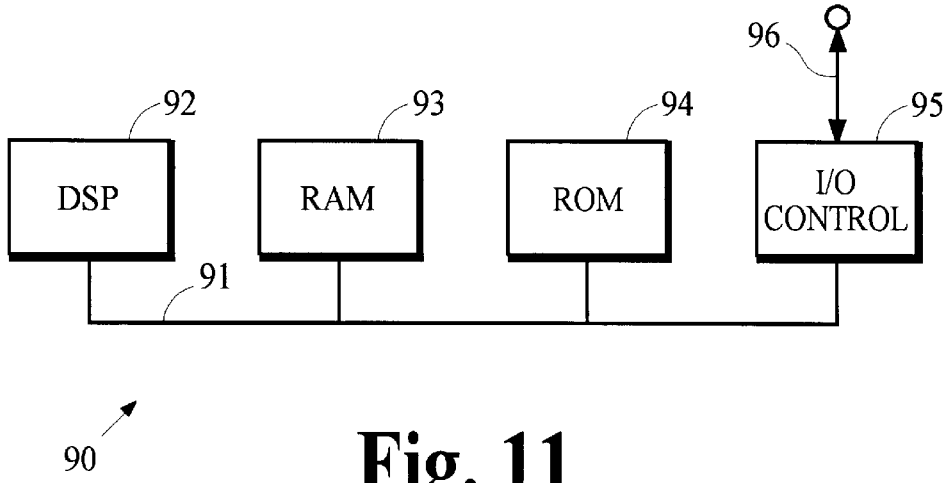
FIG. 11 is a block diagram of an apparatus that may be used to carry out various aspects of the present invention.

The present invention may be implemented in a wide variety of ways including software in a general-purpose computer system or in some other apparatus that includes more specialized components such as digital signal processor (DSP) circuitry coupled to components similar to those found in a general-purpose computer system. FIG. 11 is a block diagram of device 90 that may be used to implement various aspects of the present invention. DSP 92 provides computing resources. RAM 93 is system random access memory (RAM). ROM 94 represents some form of persistent storage such as read only memory (ROM) for storing programs needed to operate device 90 and to carry out various aspects of the present invention. I/O control 95 represents interface circuitry to receive and transmit audio signals by way of communication channel 96. Analog-to-digital converters and digital-to-analog converters may be included in I/O control 95 as desired to receive and/or transmit analog audio signals. In the embodiment shown, all major system components connect to bus 91 which may represent more than one physical bus; however, a bus architecture is not required to implement the present invention.

In embodiments implemented in a general purpose computer system, additional components may be included for interfacing to devices such as a keyboard or mouse and a display, and for controlling a storage device having a storage medium such as magnetic tape or disk or an optical medium. The storage medium may be used to record programs of instructions for operating systems, utilities and applications, and may include embodiments of programs that implement various aspects of the present invention.

The functions required to practice various aspects of the present invention can be performed by components that are implemented in a wide variety of ways including discrete logic components, one or more ASICs and/or program-controlled processors. The manner in which these components are implemented is not important to the present invention.

Software implementations of the present invention may be conveyed by a variety machine readable media such as baseband or modulated communication paths throughout the spectrum including from supersonic to ultraviolet frequencies, or storage media including those that convey information using essentially any magnetic or optical recording technology including magnetic tape, magnetic disk, and optical disc. Various aspects can also be implemented in various components of computer system 90 by processing circuitry such as ASICs, general-purpose integrated circuits, microprocessors controlled by programs embodied in various forms of read-only memory (ROM) or RAM, and other techniques.

What is claimed is:

1. A method for establishing quantization resolutions for quantizing subband signals obtained from analysis filters that are applied to an input signal, wherein an output signal that is a replica of the input signal is to be obtained by applying synthesis filters to dequantized representations of the quantized subband signals and by applying an overlap-add process to blocks of information obtained from the synthesis filters, the method comprising:

generating a desired noise spectrum in response to the input signal; and determining the quantization resolutions for the subband signals by applying a synthesis-filter noise-spreading model to obtain estimated noise levels in subbands of the output signal obtained from the synthesis filters, wherein the synthesis-filter noise-spreading model represents noise-spreading characteristics of the synthesis filters and accounts for effects of the overlap-add process, and wherein the quantization resolutions are determined such that a comparison of the desired-noise spectrum with the estimated noise levels satisfies one or more comparison criteria.

2. A method according to claim 1 that determines the quantization resolutions for the subband signals by a process that applies the synthesis-filter noise-spreading model to proposed quantization resolutions and adjusts the proposed quantization resolutions by a predefined amount of compensation.

3. A method according to claim 1 that determines the quantization resolutions for the subband signals by a reiterative process that applies the synthesis-filter noise-spreading model to proposed quantization resolutions, adjusts the proposed quantization resolutions, and reiterates until the one or more comparison criteria are satisfied.

4. A method according to claim 3 wherein the reiterative process comprises:

identifying one or more subband signal components the quantization of which, according to the synthesis-filter noise-spreading model, contributes to a portion of the estimated noise levels that exceeds a corresponding portion of the desired-noise spectrum;

selecting the subband signal component the quantization of which, according to the synthesis-filter noise-spreading model, makes the largest contribution to the portion of the estimated noise levels that exceeds the corresponding portion of the desired noise spectrum; and adjusting the respective proposed quantization resolution for the selected subband signal component.

5. A method according to claim 3 wherein the reiterative process comprises:

identifying one or more subband signal components the quantization of which, according to the synthesis-filter noise-spreading model, contributes to a portion of the estimated noise levels that exceeds a corresponding portion of the desired-noise spectrum;

selecting the subband signal component the quantization of which, according to the synthesis-filter noise-spreading model, makes the largest contribution to the portion of the estimated noise levels that exceeds the corresponding portion of the desired noise spectrum;

increasing the proposed quantization resolution for the selected subband signal component by a first amount, and increasing the proposed quantization resolution for one or more other subband signal components that are neighbors to the selected subband signal component by a second amount that is less than the first amount.

6. A method according to claim 3 wherein the reiterative process comprises:

applying the synthesis-filter noise-spreading model to obtain estimated individual noise contributions for individual subband signal components; and increasing the proposed quantization resolution for those individual subband signal components making estimated individual noise contributions that exceed the desired noise spectrum.

7. A method according to claim 1 wherein the synthesis-filter noise-spreading model is a function that expresses synthesis filter output noise at a respective frequency as a function of synthesis filter input noise at a plurality of frequencies.

8. A method according to claim 1 that comprises quantizing the subband signals according to the determined quantization resolutions and assembling the quantized subband signals into an encoded signal.

9. A method according to claim 1 that comprises obtaining the quantized subband signals from an encoded signal and dequantizing the quantized subband signals according to the determined quantization resolutions.

10. An apparatus for establishing quantization resolutions for quantizing subband signals obtained from analysis filters that are applied to an input signal, wherein an output signal that is a replica of the input signal is to be obtained by applying synthesis filters to dequantized representations of the quantized subband signals and by applying an overlap-add process to blocks of information obtained from the synthesis filters, the apparatus comprising:

an input terminal that receives the input signal; and one or more processing circuits coupled to the input terminal for generating a desired noise spectrum in response to the input signal, and for determining the quantization resolutions for the subband signals by applying a synthesis-filter noise-spreading model to obtain estimated noise levels in subbands of the output signal obtained from the synthesis filters, wherein the synthesis-filter noise-spreading model represents noise-spreading characteristics of the synthesis filters and accounts for effects of the overlap-add process, and wherein the quantization resolutions are determined such that a comparison of the desired-noise spectrum with the estimated noise levels satisfies one or more comparison criteria.

11. An apparatus according to claim 10 wherein the one or more processing circuits determine the quantization resolutions for the subband signals by performing a process that applies the synthesis-filter noise-spreading model to proposed quantization resolutions and adjusts the proposed quantization resolutions by a predefined amount of compensation.

12. An apparatus according to claim 10 wherein the one or more processing circuits determine the quantization resolutions for the subband signals by performing a reiterative process that applies the synthesis-filter noise-spreading model to proposed quantization resolutions, adjusts the proposed quantization resolutions, and reiterates until the one or more comparison criteria are satisfied.

13. An apparatus according to claim 12 wherein the reiterative process comprises:

identifying one or more subband signal components the quantization of which, according to the synthesis-filter noise-spreading model, contributes to a portion of the estimated noise levels that exceeds a corresponding portion of the desired-noise spectrum;

selecting the subband signal component the quantization of which, according to the synthesis-filter noise-spreading model, makes the largest contribution to the portion of the estimated noise levels that exceeds the corresponding portion of the desired noise spectrum; and adjusting the respective proposed quantization resolution for the selected subband signal component.

14. An apparatus according to claim 12 wherein the reiterative process comprises:

identifying one or more subband signal components the quantization of which, according to the synthesis-filter noise-spreading model, contributes to a portion of the estimated noise levels that exceeds a corresponding portion of the desired-noise spectrum;

selecting the subband signal component the quantization of which, according to the synthesis-filter noise-spreading model, makes the largest contribution to the portion of the estimated noise levels that exceeds the corresponding portion of the desired noise spectrum;

increasing the proposed quantization resolution for the selected subband signal component by a first amount, and increasing the proposed quantization resolution for one or more other subband signal components that are neighbors to the selected subband signal component by a second amount that is less than the first amount.

15. An apparatus according to claim 12 wherein the reiterative process comprises:

applying the synthesis-filter noise-spreading model to obtain estimated individual noise contributions for individual subband signal components; and increasing the proposed quantization resolution for those individual subband signal components making estimated individual noise contributions that exceed the desired noise spectrum.

16. An apparatus according to claim 10 wherein the one or more processing circuits apply the synthesis-filter noise-spreading model that is a function that expresses synthesis filter output noise at a respective frequency as a function of synthesis filter input noise at a plurality of frequencies.

17. An apparatus according to claim 10 wherein the one or more processing circuits generate an encoded representation of the input signal by quantizing the subband signals according to the determined quantization resolutions and assembling the quantized subband signals into the encoded signal.

18. An apparatus according to claim 10 wherein the one or more processing circuits decode an encoded signal conveying the quantized subband signals by extracting the quantized subband signals from the encoded signal and dequantizing the quantized subband signals according to the determined quantization resolutions.

19. A receiver that receives and decodes a signal conveying encoded information and generates an output signal by applying synthesis filters to dequantized representations of quantized components of subband signals and by applying an overlap-add process to blocks of information obtained from the synthesis filters, wherein the encoded information comprises:

(1) signal information that represents the quantized components of subband signals generated by an encoder that applies analysis filters to an input signal; and (2) control information that represents quantizing resolutions of the quantized subband signal components, wherein the quantizing resolutions are determined in the encoder by (a) generating a desired noise spectrum in response to the input signal; and (b) applying a synthesis-filter noise-spreading model to obtain estimated noise levels in subbands of an output signal obtained from synthesis filters, wherein the synthesis-filter noise-spreading model represents noise-spreading characteristics of the synthesis filters and the overlap-add process, and wherein the quantization resolutions are determined such that a comparison of the desired-noise spectrum with the estimated noise levels satisfies one or more comparison criteria;

and wherein the receiver comprises:

(1) an input coupled to the signal conveying the encoded information;

(2) one or more processing circuits coupled to the input that (a) extract the signal information and the control information from the encoded information and obtain therefrom the quantized subband signal components and the quantizing resolutions of the quantized subband signal components;

(b) dequantize the quantized subband signal components according to the quantizing resolutions to obtain dequantized subband signals; and (c) apply the synthesis filters to the dequantized subband signals and apply the overlap-add process to blocks of information obtained from the synthesis filters to generate an output signal, wherein quantizing noise in the subband signals is spread by the synthesis filters to produce noise levels in subbands of the output signal that substantially satisfy the one or more comparison criteria with the desired-noise spectrum; and (3) an output coupled to the one or more processing circuits that conveys the output signal.

20. A receiver according to claim 19 wherein the one or more comparison criteria is that noise levels in subbands of the output signal are offset from the desired-noise spectrum by amounts that are substantially constant.

21. A medium conveying encoded information to be decoded by applying synthesis filters to dequantized representations of quantized components of subband signals and by applying an overlap-add process to blocks of information obtained from the synthesis filters, wherein the encoded information comprises:

(1) signal information that represents the quantized components of subband signals generated by applying analysis filters to an input signal; and (2) control information that represents quantizing resolutions of the quantized subband signal components, wherein the quantizing resolutions are determined by (a) generating a desired noise spectrum in response to the input signal; and (b) applying a synthesis-filter noise-spreading model to obtain estimated noise levels in subbands of an output signal obtained from synthesis filters, wherein the synthesis-filter noise-spreading model represents noise-spreading characteristics of the synthesis filters and accounts for effects of the overlap-add process, and wherein the quantization resolutions are determined such that a comparison of the desired-noise spectrum with the estimated noise levels satisfies one or more comparison criteria.

22. A medium according to claim 21 wherein the one or more comparison criteria is that noise levels in subbands of the output signal are offset from the desired-noise spectrum by amounts that are substantially constant.

23. A medium readable by a device embodying a program of instructions for execution by the device to perform a method for establishing quantization resolutions for quantizing subband signals obtained from analysis filters that are applied to an input signal, wherein an output signal that is a replica of the input signal is to be obtained by applying synthesis filters to dequantized representations of the quantized subband signals and by applying an overlap-add process to blocks of information obtained from the synthesis filters, the method comprising:

generating a desired noise spectrum in response to the input signal; and determining the quantization resolutions for the subband signals by applying a synthesis-filter noise-spreading model to obtain estimated noise levels in subbands of the output signal obtained from the synthesis filters, wherein the synthesis-filter noise-spreading model represents noise-spreading characteristics of the synthesis filters and accounts for effects of the overlap-add process, and wherein the quantization resolutions are determined such that a comparison of the desired-noise spectrum with the estimated noise levels satisfies one or more comparison criteria.

24. A medium according to claim 23 that determines the quantization resolutions for the subband signals by a process that applies the synthesis-filter noise-spreading model to proposed quantization resolutions and adjusts the proposed quantization resolutions by a predefined amount of compensation.

25. A medium according to claim 23 that determines the quantization resolutions for the subband signals by a reiterative process that applies the synthesis-filter noise-spreading model to proposed quantization resolutions, adjusts the proposed quantization resolutions, and reiterates until the one or more comparison criteria are satisfied.

26. A medium according to claim 25 wherein the reiterative process comprises:

identifying one or more subband signal components the quantization of which, according to the synthesis-filter noise-spreading model, contributes to a portion of the estimated noise levels that exceeds a corresponding portion of the desired-noise spectrum;

selecting the subband signal component the quantization of which, according to the synthesis-filter noise-spreading model, makes the largest contribution to the portion of the estimated noise levels that exceeds the corresponding portion of the desired noise spectrum; and adjusting the respective proposed quantization resolution for the selected subband signal component.

27. A medium according to claim 25 wherein the reiterative process comprises:

identifying one or more subband signal components the quantization of which, according to the synthesis-filter noise-spreading model, contributes to a portion of the estimated noise levels that exceeds a corresponding portion of the desired-noise spectrum;

selecting the subband signal component the quantization of which, according to the synthesis-filter noise-spreading model, makes the largest contribution to the portion of the estimated noise levels that exceeds the corresponding portion of the desired noise spectrum;

increasing the proposed quantization resolution for the selected subband signal component by a first amount, and increasing the proposed quantization resolution for one or more other subband signal components that are neighbors to the selected subband signal component by a second amount that is less than the first amount.

28. A medium according to claim 25 wherein the reiterative process comprises:

applying the synthesis-filter noise-spreading model to obtain estimated individual noise contributions for individual subband signal components; and increasing the proposed quantization resolution for those individual subband signal components making estimated individual noise contributions that exceed the desired noise spectrum.

29. A medium according to claim 23 wherein the synthesis-filter noise-spreading model is a function that expresses synthesis filter output noise at a respective frequency as a function of synthesis filter input noise at a plurality of frequencies.

30. A medium according to claim 23 wherein the method comprises quantizing the subband signals according to the determined quantization resolutions and assembling the quantized subband signals into an encoded signal.

31. A medium according to claim 23 wherein the method comprises obtaining the quantized subband signals from an encoded signal and dequantizing the quantized subband signals according to the determined quantization resolutions.

* * * * *

UNITED STATES PATENT AND TRADEMARK OFFICE

CERTIFICATE OF CORRECTION

PATENT NO. : 6,363,338 B1
APPLICATION NO. : 09/289865
DATED : March 26, 2002
INVENTOR(S) : Anil Wamanrao Ubale et al.

It is certified that error appears in the above-identified patent and that said Letters Patent is hereby corrected as shown below:

On the Title Page, Item (54) in the patent Title, after "Synthesis Filter Noise Spreading" insert --and the Overlap-Add Process--

On the Title Page, Item (57) in line 9 of the Abstract in the Patent, after "noise spreading" insert --and the overlap-add process--

In Column 1 Line 11 of the patent, after "synthesis filters" insert --and the overlap-add process--

In Column 3 Line 18 of the patent, after "synthesis filters" insert --and the overlap-add process--

In Column 9 line 8 of the patent, after "synthesis filters" insert --and the overlap-add process--

In Column 9 Lines 58 to 62 of the patent, the formula should appear as follows:

-- $$X_m(k) = \sum_{n=0}^{2M-1} w_A(n) \cdot x_m(n) \cdot \cos\left[\frac{2\pi(n+n_0)(k+k_0)}{2M}\right] \quad \text{for } 0 \le k < 2M, \quad (1)$$ -- as it appears on page 14 Line 17 of the application.

In Column 10 Lines 29 to 33 of the patent, the formula should appear as follows:

-- $$\hat{x}_m(n) = \frac{1}{2M} \sum_{k=0}^{2M-1} \hat{X}_m(k) \cdot \cos\left[\frac{2\pi(k+k_0)(n+n_0)}{2M}\right] \quad \text{for } 0 \le n < 2M, \quad (3)$$ -- as it appears on Page 15 Line 6 of the application.

In Column 11 Lines 14 to 17 of the patent, the formula should appear as follows:

-- $$\hat{Y}_m(k) = \sum_{n=0}^{2M-1} \hat{y}_m(n) \cdot \cos\left[\frac{2\pi(n+n_0)(k+k_0)}{2M}\right] \quad \text{for } 0 \le k < 2M, \quad (5)$$ -- as it appears on Page 16 Line 9 of application.

In Column 11 Lines 34 to 37 of the patent, the formula should appear as follows:

-- $$Y_m(k) = \sum_{n=0}^{2M-1} y_m(n) \cdot \cos\left[\frac{2\pi(n+n_0)(k+k_0)}{2M}\right] \quad \text{for } 0 \le k < 2M. \quad (7)$$ -- as it appears on Page 16 Line 18 of the application.

UNITED STATES PATENT AND TRADEMARK OFFICE

CERTIFICATE OF CORRECTION

PATENT NO. : 6,363,338 B1
APPLICATION NO. : 09/289865
DATED : March 26, 2002
INVENTOR(S) : Anil Wamanrao Ubale et al.

It is certified that error appears in the above-identified patent and that said Letters Patent is hereby corrected as shown below:

In Column 12 Lines 23 to 48 of the patent, the formulas should appear as follows:

-- $$\hat{Y}_m(k) = \sum_{q=0}^{2M-1} A(k,q)\cdot \hat{X}_m(q) + B(k,q)\cdot \hat{X}_{m-1}(q) + C(k,q)\cdot \hat{X}_{m+1}(q) \qquad (9a)$$

where $$A(k,q) = \frac{1}{M}\sum_{n=0}^{2M-1} w_S(n)\cdot \cos\left[\frac{2\pi(n+n_0)(k+k_0)}{2M}\right]\cdot \cos\left[\frac{2\pi(n+n_0)(q+q_0)}{2M}\right];$$

$$B(k,q) = \frac{1}{M}\sum_{n=0}^{2M-1} w_S(n+M)\cdot \cos\left[\frac{2\pi(n+M+n_0)(k+k_0)}{2M}\right]\cdot \cos\left[\frac{2\pi(n+n_0)(q+q_0)}{2M}\right];$$

$$C(k,q) = \frac{1}{M}\sum_{n=0}^{2M-1} w_S(n-M)\cdot \cos\left[\frac{2\pi(n-M+n_0)(k+k_0)}{2M}\right]\cdot \cos\left[\frac{2\pi(n+n_0)(q+q_0)}{2M}\right]$$

and $q_0 = ½$; for $0 \le k < 2M$. -- as it appears on Page 17 Lines 22 to 26 of the application.

In Column 12 Lines 58 to 61 of the patent, the formula should appear as follows:

-- $$Y_m(k) = \sum_{q=0}^{2M-1} A(k,q)\cdot X_m(q) + B(k,q)\cdot X_{m-1}(q) + C(k,q)\cdot X_{m+1}(q) \qquad (9b)$$ -- as it appears on Page 18 Line 4 of the application.

In Column 13 Lines 1 to 4 of the patent, the formula should appear as follows:

-- $$O_m(k) = \sum_{q=0}^{2M-1} A(k,q)\cdot I_m(q) + B(k,q)\cdot I_{m-1}(q) + C(k,q)\cdot I_{m+1}(q) \qquad (10)$$ -- as it appears on Page 18 Line 8 of the application.

In Column 13 Lines 20 to 23 of the patent, the formula should appear as follows:

-- $$O_m(k) = \sum_{q=0}^{M-1} A'(k,q)\cdot I_m(q) + B'(k,q)\cdot I_{m-1}(q) + C'(k,q)\cdot I_{m+1}(q) \qquad (13)$$ -- as it appears on Page 18 Line 17 of the application.

UNITED STATES PATENT AND TRADEMARK OFFICE

CERTIFICATE OF CORRECTION

PATENT NO. : 6,363,338 B1
APPLICATION NO. : 09/289865
DATED : March 26, 2002
INVENTOR(S) : Anil Wamanrao Ubale et al.

It is certified that error appears in the above-identified patent and that said Letters Patent is hereby corrected as shown below:

In Column 13 Lines 37 to 41 of the patent, the formula should appear as follows:

-- $$N_{O,m}(k) = \mathrm{E}\left(\left|O_m(k)\right|^2\right) = \sum_{q=0}^{M-1} A''(k,q)\cdot N_{I,m}(q) + B''(k,q)\cdot N_{I,m-1}(q) + C''(k,q)\cdot N_{I,m+1}(q) \quad (14)$$

for $0 \le k < M$, -- as it appears on Page 19 Lines 1 to 3 of the application.

In Column 13 Lines 57 to 58 of the patent, the formula should appear as follows:

-- $$N_{O,m}(k) = \sum_{q=0}^{M-1} W(k,q)\cdot N_{I,m}(q) \quad \text{for } 0 \le k < M, \quad (15)$$ -- as it appears on Page 19 Line 11 of the application.

In Column 14 Line 1 of the patent, the formula should appear as follows:

-- $$N_{O,m}(k) = \sum_{q=0}^{M-1} W(k,q)\cdot N_{I,m}(q) \le N(k) \quad \text{for } 0 \le k < M. \quad (16)$$ -- as it appears on Page 19 Line 18 of the application.

In Column 14 Line 9 to 10 of the patent, the formula should appear as follows:

-- $$N_{I,m}(k) = \sum_{q=0}^{M-1} W^{-1}(k,q)\cdot N(q) \quad \text{for } 0 \le k < M. \quad (17)$$ -- as it appears on Page 19 Line 20 of the application.

In Column 16 Lines 39 to 41 of the patent, the formula should appear as follows:

-- $$N(k) \ge \sum_{q=0}^{M-1} W(k,q)\cdot g(q)\cdot N(q) = \sum_{q=0}^{M-1} D(k,q)\cdot g(q) \quad (23)$$ -- as it appears on Page 23 Line 8 of the application.

In Column 16 Line 50 of the patent, the formula should appear as follows:

-- $$K = \min\left[\sum_{k} -\log\, g(k)\right] \quad (25)$$ -- as it appears on Page 23 Line 12 of the application.

UNITED STATES PATENT AND TRADEMARK OFFICE

CERTIFICATE OF CORRECTION

PATENT NO. : 6,363,338 B1
APPLICATION NO. : 09/289865
DATED : March 26, 2002
INVENTOR(S) : Anil Wamanrao Ubale et al.

It is certified that error appears in the above-identified patent and that said Letters Patent is hereby corrected as shown below:

In Column 17 Lines 33 to 34 of the patent, the formula should appear as follows:

-- $$Q(k) = \frac{10 \cdot \left(2 \cdot \log|X(k)| - \log N_{I,m}(k)\right)}{6.02}$$ -- as it appears on Page 24 Line 17 of the application.

In Column 17 Lines 53 to 55 of the patent, the formula should appear as follows:

-- $$d = \frac{N(i)}{\sqrt{D(i,0)^2 + D(i,1)^2 + \cdots D(i,M-1)^2}}.$$ -- as it appears on Page 25 Line 1 of the application.

In Column 18 Line 10 of the patent, the formula should appear as follows:

-- $$Q(k) = \frac{10 \cdot \left(2 \cdot \log|X(k)| - \log g(k) - \log N_{I,m}(k)\right)}{6.02}$$ -- as it appears on Page 25 Line 16 of the application.

In Column 19 Lines 47 to 49 of the patent, the formula should appear as follows:

-- $$\sum_{i=k-L1}^{k+L2} W(k,i) \cdot g(i) \cdot N(i) \quad \text{for } 0 \le i < \mathrm{M2},$$ -- as it appears on Page 27 Line 35 of the application.

UNITED STATES PATENT AND TRADEMARK OFFICE

CERTIFICATE OF CORRECTION

PATENT NO. : 6,363,338 B1 
APPLICATION NO. : 09/289865
DATED : March 26, 2002
INVENTOR(S) : Anil Wamanrao Ubale et al.

It is certified that error appears in the above-identified patent and that said Letters Patent is hereby corrected as shown below:

In Column 20 lines 58 to 60 of the patent, the formula should appear as follows:

-- $$g_new = N(k) - \frac{\sum W(k,i) \cdot g(i) \cdot N(i) \quad \text{for } i \notin \{S\}}{\sum W(k,i) \cdot N(i) \quad \text{for } i \in \{S\}} .$$ -- as it appears on Page 29 Line 3 of the application.

Signed and Sealed this

Thirty-first Day of July, 2007

JON W. DUDAS
*Director of the United States Patent and Trademark Office*